US010302290B2

(12) United States Patent
Sutton

(10) Patent No.: US 10,302,290 B2
(45) Date of Patent: May 28, 2019

(54) LIGHT UP ARTICLE HAVING MULTIPLE LIGHT EFFECTS

(71) Applicant: Alan Sutton, Voorhees Township, NJ (US)

(72) Inventor: Alan Sutton, Voorhees Township, NJ (US)

( * ) Notice: Subject to any disclaimer, the term of this patent is extended or adjusted under 35 U.S.C. 154(b) by 0 days.

(21) Appl. No.: 15/847,393

(22) Filed: Dec. 19, 2017

(65) Prior Publication Data

US 2018/0187876 A1 Jul. 5, 2018

Related U.S. Application Data

(60) Provisional application No. 62/440,498, filed on Dec. 30, 2016.

(51) Int. Cl.

| | |
|---|---|
| ***A63H 3/00*** | (2006.01) |
| ***F21V 33/00*** | (2006.01) |
| ***F21V 23/04*** | (2006.01) |
| ***F21V 11/08*** | (2006.01) |
| *F21Y 113/10* | (2016.01) |
| *F21Y 115/10* | (2016.01) |

(52) U.S. Cl.

CPC ..... *F21V 23/04* (2013.01); *A63H 3/006* (2013.01); *F21V 11/08* (2013.01); *F21V 33/008* (2013.01); *F21Y 2113/10* (2016.08); *F21Y 2115/10* (2016.08)

(58) Field of Classification Search

CPC ..... A63H 3/003; A63H 3/006; A63H 3/16; A63H 33/00; A63H 33/042; A63H 33/26; F21V 33/008; F21V 33/00

See application file for complete search history.

(56) References Cited

U.S. PATENT DOCUMENTS

| | | | | |
|---|---|---|---|---|
| 2,745,947 A | | 5/1956 | Sansous | |
| 3,520,078 A | * | 7/1970 | Klamer ..... | A63H 3/16 446/125 |
| 4,330,050 A | | 5/1982 | Sangster et al. | |

(Continued)

FOREIGN PATENT DOCUMENTS

| | | |
|---|---|---|
| JP | 3177411 | 8/2012 |
| WO | 2015/195813 A2 | 12/2015 |
| WO | 2017116901 | 7/2017 |

OTHER PUBLICATIONS

International Search Report and Written Opinion for Application No. PCT/US2105/39217 dated Nov. 19, 2015 (10 pages).

(Continued)

*Primary Examiner* — Eugene L Kim
*Assistant Examiner* — Alyssa M Hylinski
(74) *Attorney, Agent, or Firm* — Michael Best & Friedrich LLP

(57) ABSTRACT

A light-up article includes a housing having an aperture at a bottom that receives a lighting device that extends outwardly therefrom. The lighting device includes a spring biased assembly for biasing a contact switch therein to an open position. When force is applied to the article downwardly, springs compress as housing members of the lighting device approach and the contact switch actuates. Actuation results in an electrical circuit outputting light from a light emitter at the top of the lighting device that is viewable through a translucent housing of the article.

19 Claims, 26 Drawing Sheets

(56) References Cited

U.S. PATENT DOCUMENTS

| | | | | |
|---|---|---|---|---|
| 4,464,861 | A | 8/1984 | Fogarty et al. | |
| 4,507,716 | A | 3/1985 | Benedict, Jr. | |
| 4,858,079 | A * | 8/1989 | Ohashi | A63H 5/00 362/35 |
| 5,211,282 | A * | 5/1993 | Ting | A63H 3/28 200/292 |
| 5,434,761 | A * | 7/1995 | Lesnick | A63H 3/006 362/189 |
| 5,667,296 | A | 9/1997 | Cheng et al. | |
| 5,947,581 | A | 9/1999 | Schrimmer et al. | |
| 6,005,204 | A | 12/1999 | Choi et al. | |
| 6,032,580 | A | 3/2000 | Lee | |
| 6,109,763 | A * | 8/2000 | Ohta | A63H 3/006 362/124 |
| 6,164,793 | A * | 12/2000 | Wu | A47G 19/2227 362/101 |
| 6,224,234 | B1 * | 5/2001 | Demmery | A45C 15/06 362/154 |
| 6,341,882 | B1 * | 1/2002 | Lin | A63H 3/006 101/405 |
| 7,419,072 | B1 | 9/2008 | Vanella | |
| 7,520,633 | B2 | 4/2009 | Hornsby et al. | |
| 9,109,793 | B2 * | 8/2015 | Menow | A63H 33/22 |
| 9,573,075 | B1 * | 2/2017 | Capriola | A63H 33/042 |
| 2003/0016530 | A1 * | 1/2003 | Yang | B43K 29/10 362/118 |
| 2004/0007710 | A1 * | 1/2004 | Roy | B44C 5/005 257/88 |
| 2004/0032731 | A1 * | 2/2004 | Coleman | A23G 3/50 362/109 |
| 2004/0067713 | A1 | 4/2004 | Fong | |
| 2004/0114352 | A1 | 6/2004 | Jensen | |
| 2005/0285547 | A1 | 12/2005 | Piepgras et al. | |
| 2006/0007676 | A1 * | 1/2006 | Song | A44C 15/0015 362/195 |
| 2006/0146525 | A1 * | 7/2006 | Chernick | A63B 43/06 362/196 |
| 2006/0194508 | A1 * | 8/2006 | Johnson | A63H 3/003 446/485 |
| 2007/0021244 | A1 | 1/2007 | Ko | |
| 2008/0180941 | A1 | 7/2008 | Tuan | |
| 2009/0290348 | A1 | 11/2009 | VanLaanen et al. | |
| 2009/0298384 | A1 * | 12/2009 | Connolly | A63H 3/006 446/389 |
| 2013/0040532 | A1 | 2/2013 | Khubani | |
| 2017/0135178 | A1 * | 5/2017 | Sutton | A41D 27/085 |

OTHER PUBLICATIONS

European Search Report for Application No. 15809224 dated Nov. 16, 2017 (3 pages).

International Search Report with Written Opinion for Application No. PCT/US2017/067363 dated Apr. 26, 2018 (13 pages).

International Search Report and Written Opinion for Application No. PCT/US2016/067999 dated Apr. 17, 2017 (16 pages).

International Search Report and Written Opinion for Application No. PCT/US2015/36247 dated Nov. 19, 2015, 10 pages.

* cited by examiner

LIGHT UP ARTICLE HAVING MULTIPLE LIGHT EFFECTS

RELATED APPLICATIONS

This application claims priority from U.S. provisional application 62/440,498, filed Dec. 30, 2016, the entire content of which is hereby incorporated by reference.

BACKGROUND

The present embodiments as described, relate to a light up-article, such as a toy, having multiple light effects in response to selective actuation of a switch by, for example, the application of a manual pressing force to the toy.

SUMMARY

One embodiment provides an article comprising a housing having an aperture at a bottom thereof and a lighting device secured within the aperture and extending outwardly from the aperture of the housing. The lighting device includes a contact switch, a spring biased arrangement for biasing the contact switch to an open position, and light emitters for selectively emitting light. The lighting device is configured to selectively provide light upon actuation of the contact switch by a force applied to the article.

Another embodiment provides an article comprising a housing having an aperture at a bottom thereof and a lighting device secured within the aperture and extending outwardly from the aperture of the housing. The lighting device includes an upper light housing member having a printed circuit board mounted thereon and a lower light housing member, and light emitters mounted to the printed circuit board on top of the upper light housing member for selectively emitting light. The article includes a light distributor mounted about the top of the upper light housing member and within the housing; and a light filter disposed within the light distributor, the light filter including patterns for selectively allowing light to pass. The light emitters provide light through the light filter and the light distributor to the housing of the article and the housing of the article is translucent.

Other aspects of the embodiments will become apparent by consideration of the detailed description and accompanying drawings.

DETAILED DESCRIPTION

Before any embodiments are explained in detail, it is to be understood that the embodiments are not limited in their application to the details of construction and the arrangement of components set forth in the following description or illustrated in the following drawings. Other embodiments are capable of being practiced or of being carried out in various ways.

Figure 1:
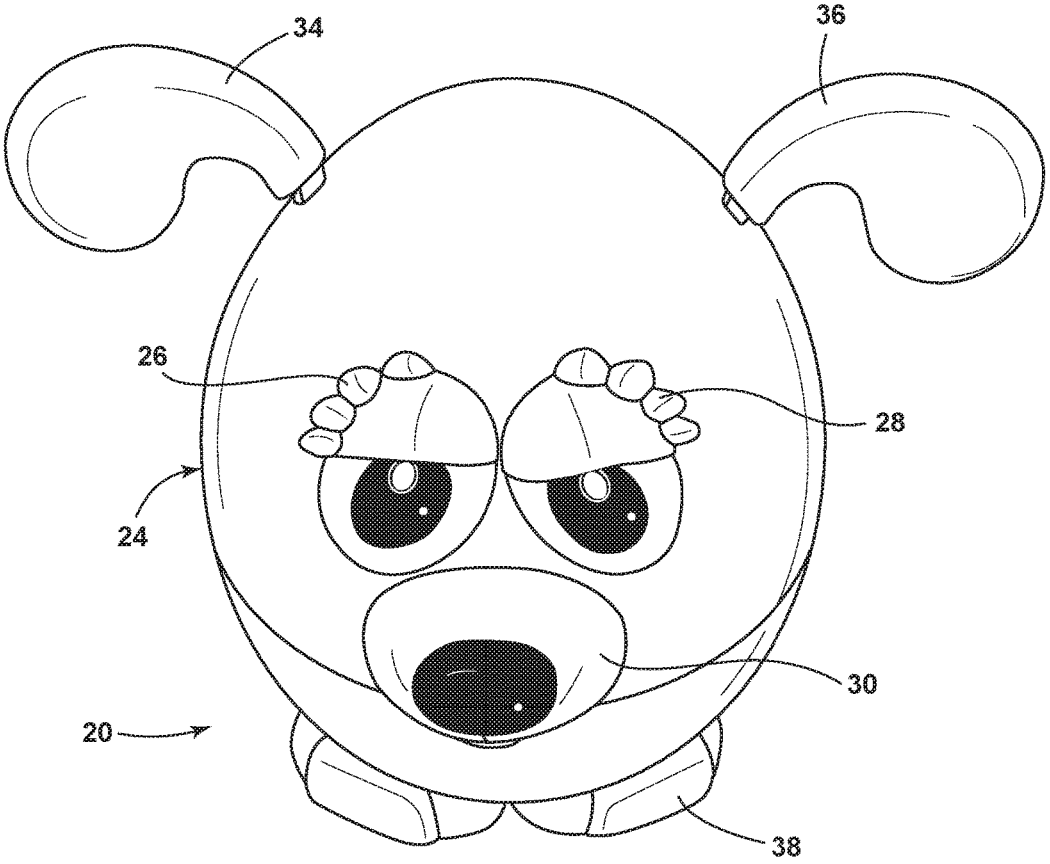
FIG. 1 illustrates a downward perspective view of one embodiment of the light-up article that is not illuminated.

FIG. 1 shows one embodiment of a light-up article 20, such as a toy, that includes a housing 24 having an oval or egg shape. In other embodiments, the article may be formed in other shapes as desired. The article 20 includes a pair of eye appendages 26, 28, a nose appendage 30, ear appendages 34, 36 and a foot appendage 38. The article 20 lights up in response to force applied thereto as set forth below.

Figure 2:
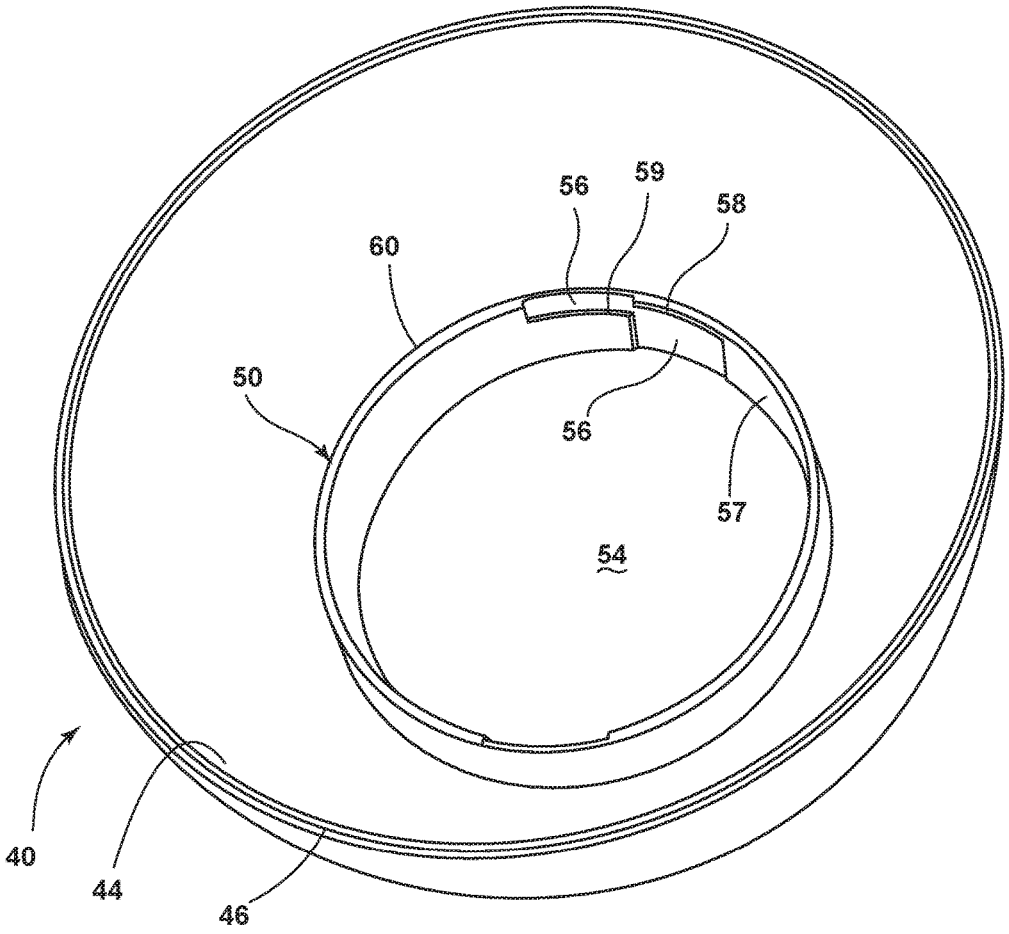
FIG. 2 illustrates a downward perspective view of a lower housing of the light-up article.
Figure 2A:
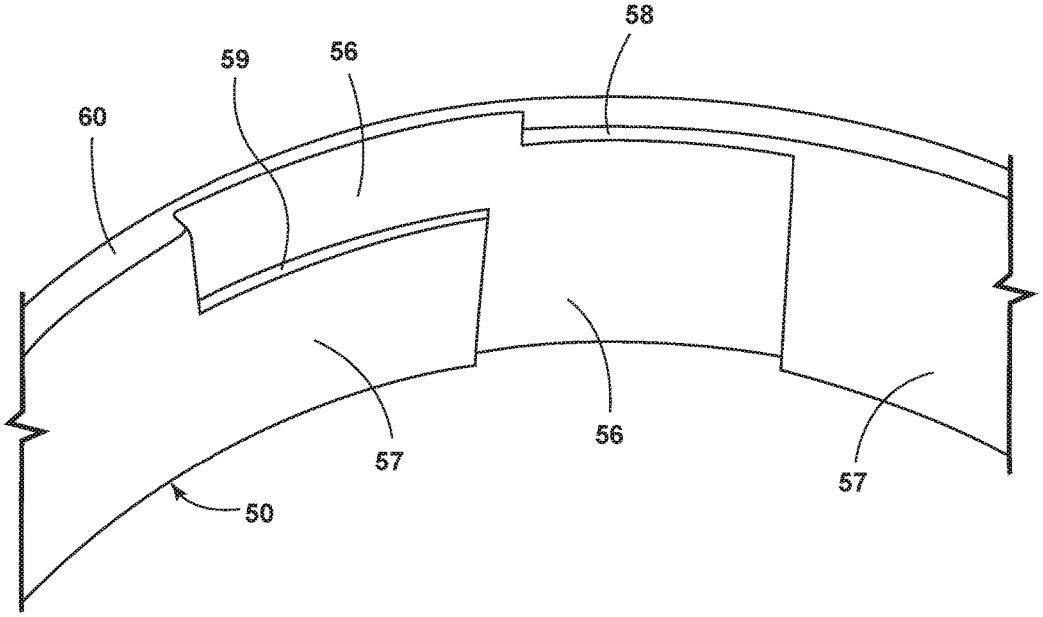
FIG. 2A is a close-up view of a slot in a flange of the lower housing.

In one exemplary embodiment, FIG. 2 shows a bottom article housing piece 40 that is one piece of two pieces that define a translucent housing 24 having an oval shape. In one embodiment, the bottom article housing piece 40 is made of a generally rigid and translucent plastic. The bottom article housing piece 40 includes a top opening 44 that includes an outwardly grooved edge 46. The bottom article housing piece 40 includes a generally cylindrical annular flange 50 projecting upwardly from a bottom that defines an open bore aperture 54. Flange 50 extends around the aperture 54. As shown in the close-up view of FIG. 2A, the annular flange 50 has a groove 56 in an inner face 57 thereof that opens at and extends downwardly from a top edge 60 of flange 50 and forms a radially inward extending lip 58 at a top edge 60 of the annular flange. As shown in FIG. 2A, the left portion of the groove 56 has an upwardly facing edge 59. A second opposing groove in the inner face 57 of the annular flange 50 is provided across from the groove 56.

Figure 3:
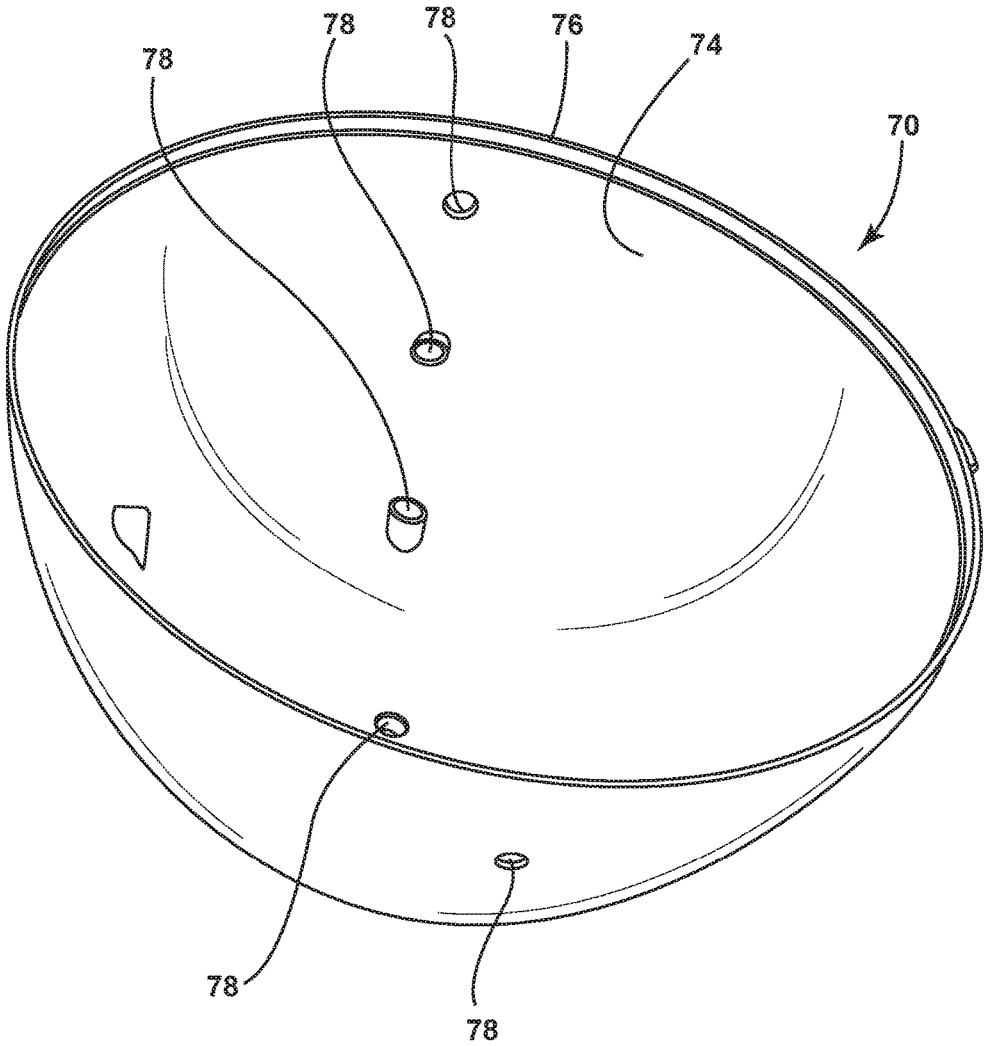
FIG. 3 illustrates an inverted perspective view of an upper housing of the light-up article.

FIG. 3 shows an upper translucent article housing piece 70 that is inverted, and in combination with the bottom article housing piece 40 defines the housing 24. The upper article housing piece 70 includes a bottom opening 74 that has an inwardly grooved edge 76 that is configured complementary to grooved edge 46 of the bottom article housing 40. The upper article housing piece 70 includes a plurality of appendage apertures 78 for receiving appendages or other decorative pieces to form various characters or other decorative items for the article 20. During assembly, the inwardly grooved edge 76 of the upper article housing piece 70 is press fit into engagement with the outwardly grooved edge 46 of the bottom article housing piece 40. The press fit connection joins the article housing pieces 40, 70 together to form the housing 24 illustrated in FIG. 1.

Figure 4:
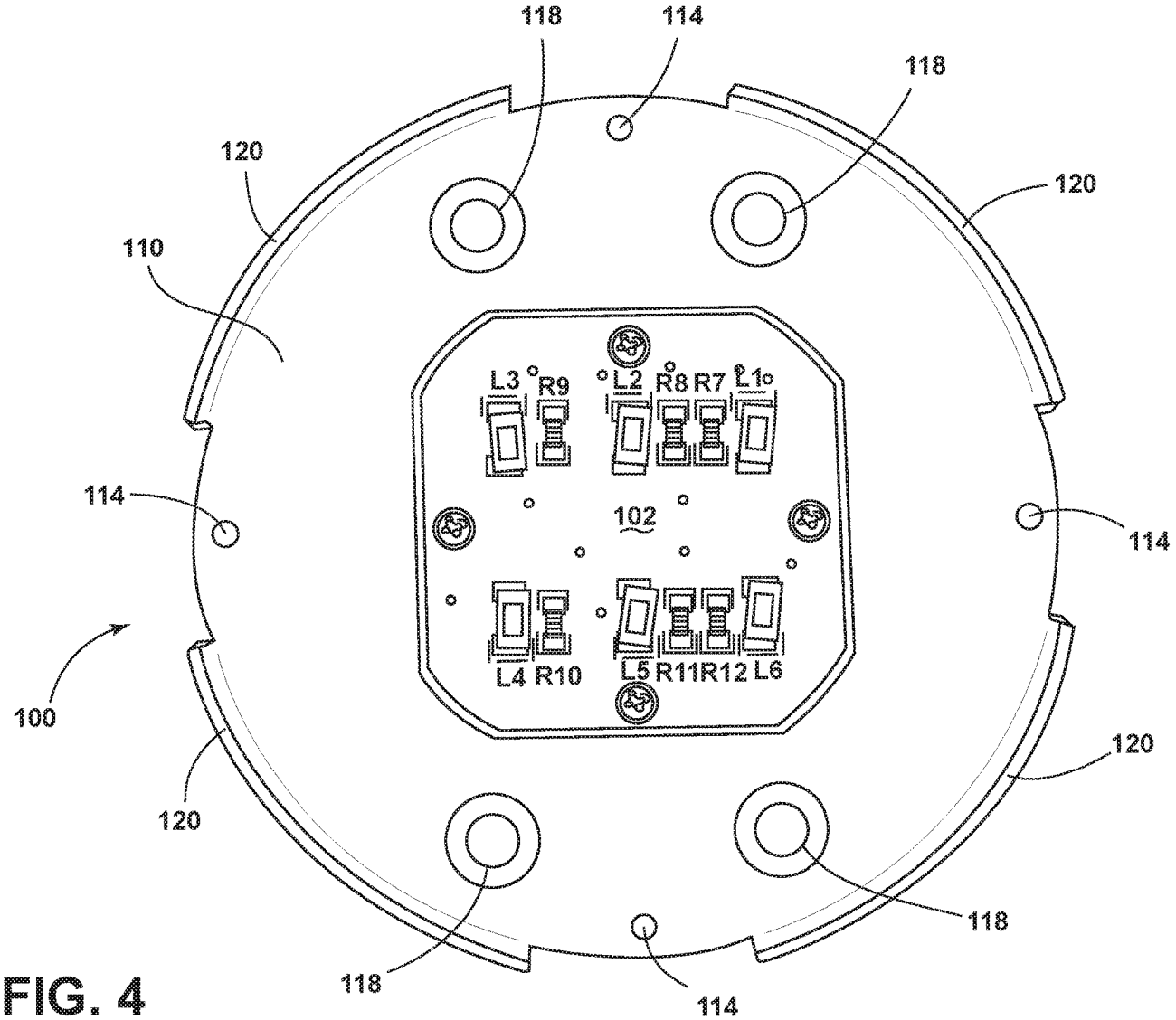
FIG. 4 illustrates a top view of a lighting device.

FIG. 4 is a top view of one embodiment of a lighting device 100. The lighting device 100 includes a printed circuit board 102 that includes a plurality of resistors R1, R7-R12 and light emitters, such as light emitting diodes (LEDs) L1-L6 for selectively emitting light. The electrical circuit of the lighting device 100 is discussed later herein.

Further, FIG. 4 shows an upper light housing member 110 of the lighting device 100 having the printed circuit board 102 mounted thereto and a set of light distributor apertures 114 for mounting a light distributor (not shown). The upper light housing member 110 also includes a set of recessed joining apertures 118 for joining with a lower light housing member 130 discussed later herein. Further, the upper light housing member 110 has a generally cylindrical disc shaped outer wall 119 (See FIG. 6) with a radially outwardly projecting flange or spaced flanges 120 provided about a top edge thereof.

Figure 5:
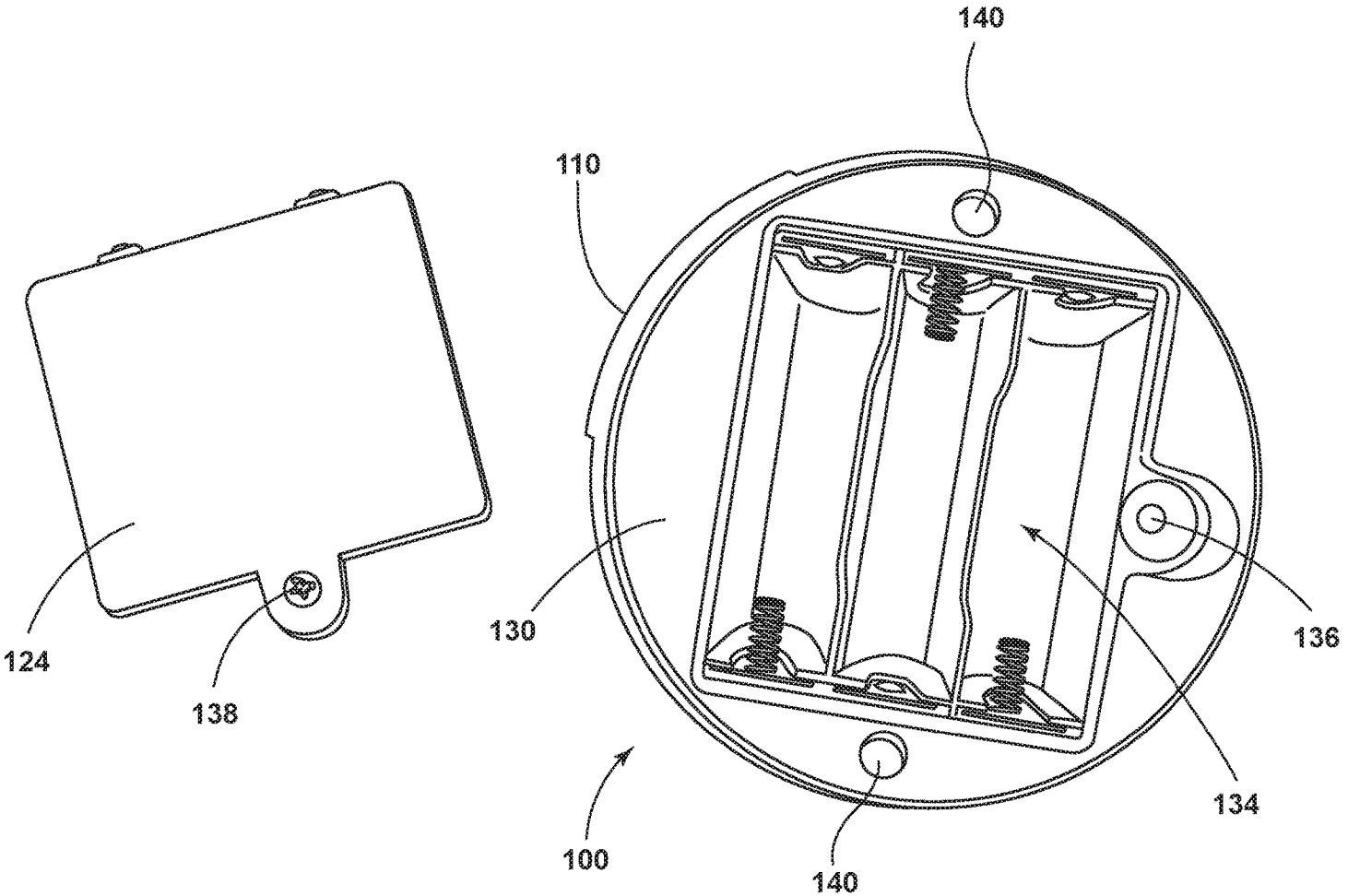
FIG. 5 illustrates a bottom view of the lighting device.

FIG. 5 shows a bottom view of a lower light housing member 130 of the lighting device 100 with a battery cover 124 removed. The lighting device 100 includes the upper light housing member 110 that partially receives the lower light housing member 130 which is nested within upper light housing member 110 as shown in FIG. 5. In FIG. 5, the lower light housing member 130 includes a battery compartment 134 for receiving three batteries and a screw hole or bore 136 for receiving a battery cover screw 138 to mount the battery cover 124 thereon. The lower light housing member 130 includes appendage apertures 140 for receiving two mounting posts of foot appendage 38 (not shown) to mount the foot appendage to the bottom of the lighting device 100.

Figure 6:
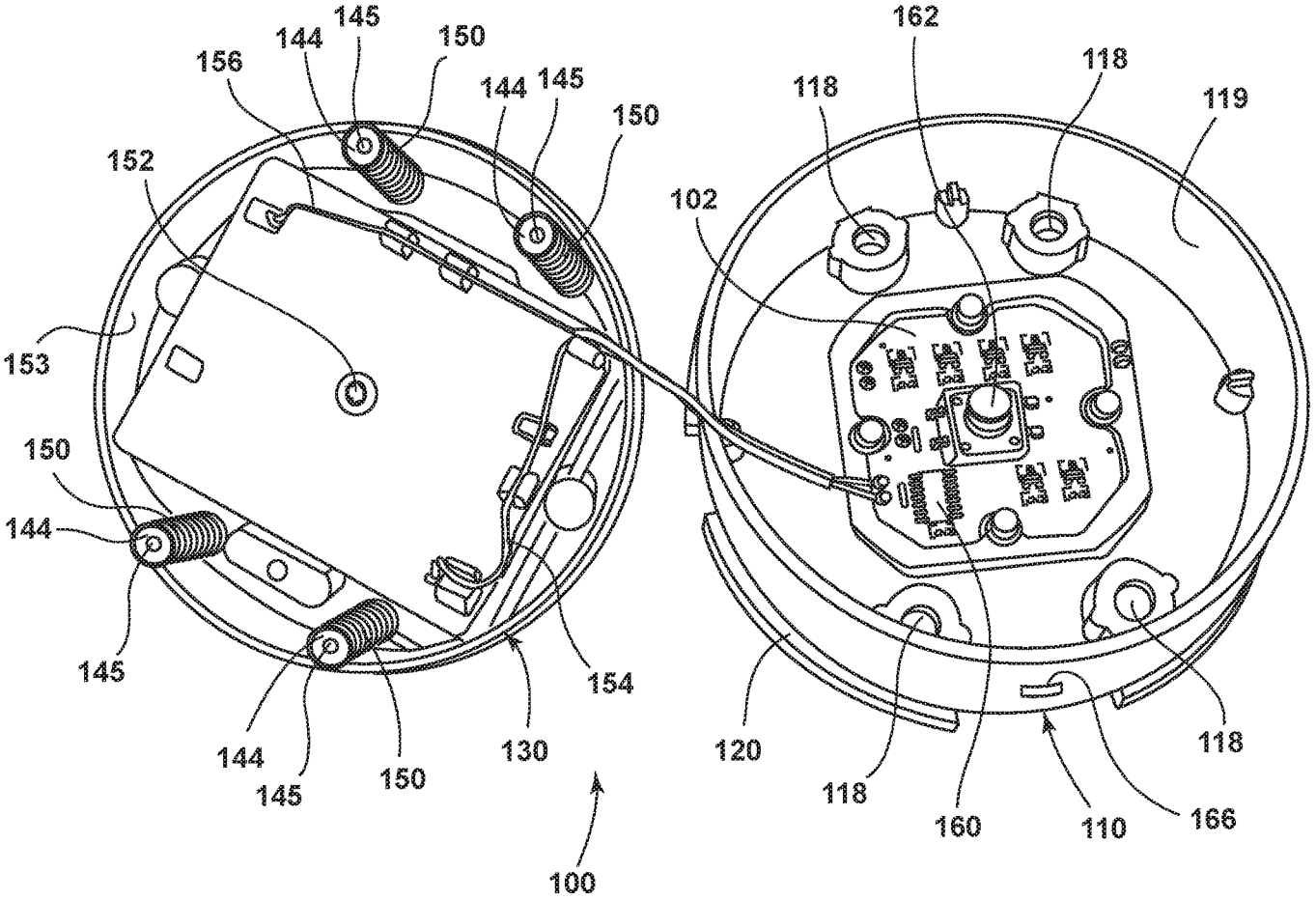
FIG. 6 illustrates an interior of the lighting device.

FIG. 6 provides interior views of the upper light housing member 110 and the lower light housing member 130 of the dissembled lighting device 100. The lower light housing member 130 includes a plurality of fastener or screw receiving posts 144. The receiving posts 144 each has a central aperture 145 to axially receive a fastener. Each receiving post 144 is provided with a surrounding spring 150 that provides a biasing force along one direction when compressed. The lower light housing member 130 includes an inwardly axially projecting contact switch tab 152 in a central location thereof. The lower light housing member 130 includes a generally cylindrical annular wall 153 disposed about an outer circumference thereof.

FIG. 6 shows a pair of wires 154, 156 for providing power from batteries disposed in the battery compartment 134 to the printed circuit board 102. The lower side of the printed circuit board 102 shown in FIG. 6 includes an integrated circuit 160 and a contact switch 162. When the lighting device 100 is assembled contact switch tab 152 aligns with contact switch 162. Details of the electrical circuit are discussed later herein. FIG. 6 also shows mounting projection 166 that projects radially outwardly from outer wall 119.

Figure 7:
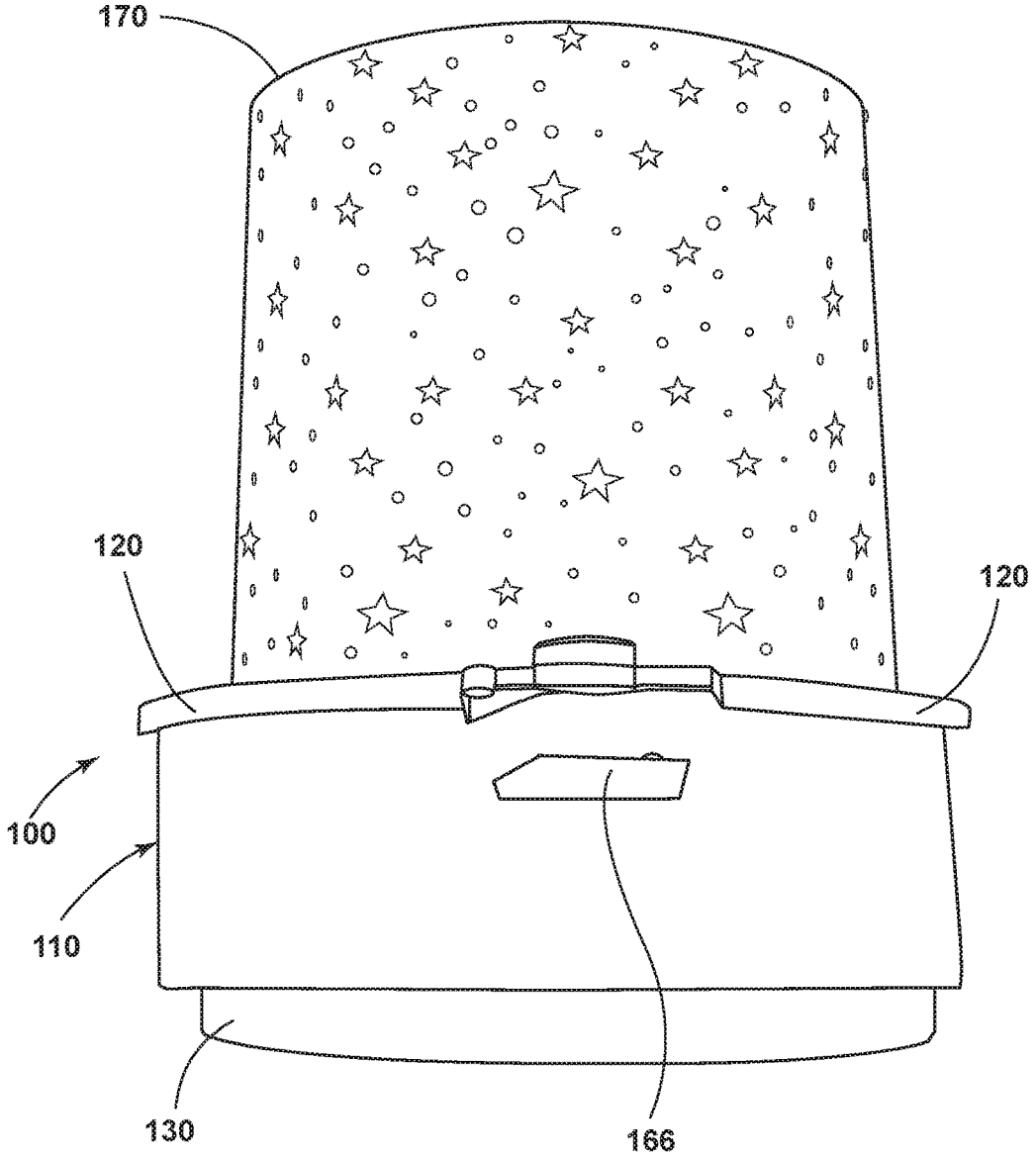
FIG. 7 illustrates a side perspective view of a light distributor mounted on the lighting device.

FIG. 7 shows a side view of the lighting device 100 having the mounting projection 166 that projects radially outwardly from the upper light housing member 110 and is spaced downwardly from the top thereof. The mounting projection 166 is elongate in a direction along outer wall 119 and oriented horizontally when the article 20 is upright. Another mounting projection 166 (not shown) projects radially outward from outer wall 119 diametrically opposite the mounting projection 166 shown in FIG. 7 on upper light housing member 110. Further, FIG. 7 shows a light distributor 170 that is mounted about the top of the upper light housing member 110 to enclose the printed circuit board 102 having LEDs L1-L6.

Figure 8:
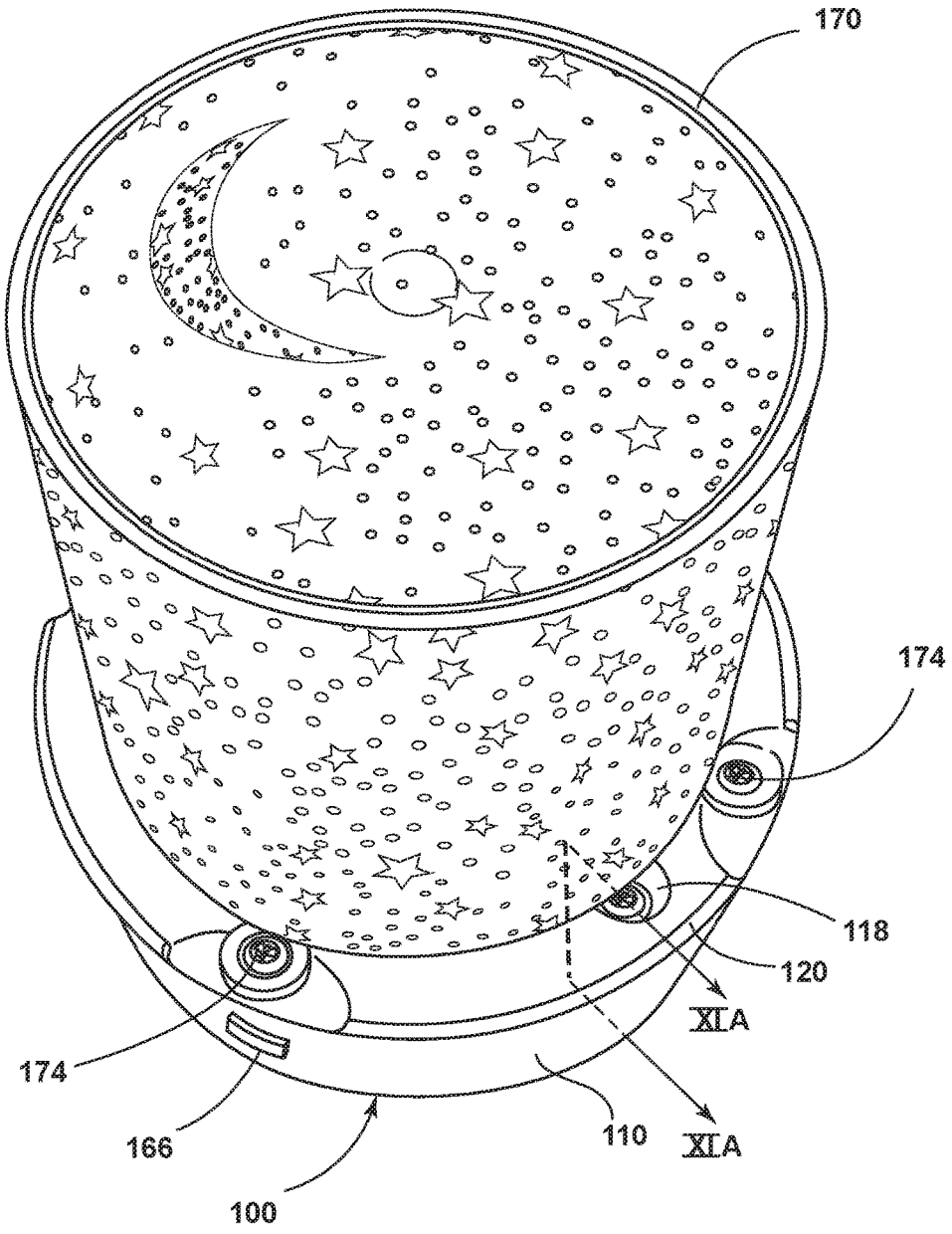
FIG. 8 is a top perspective view of the light distributor mounted on the lighting device.
Figure 9:
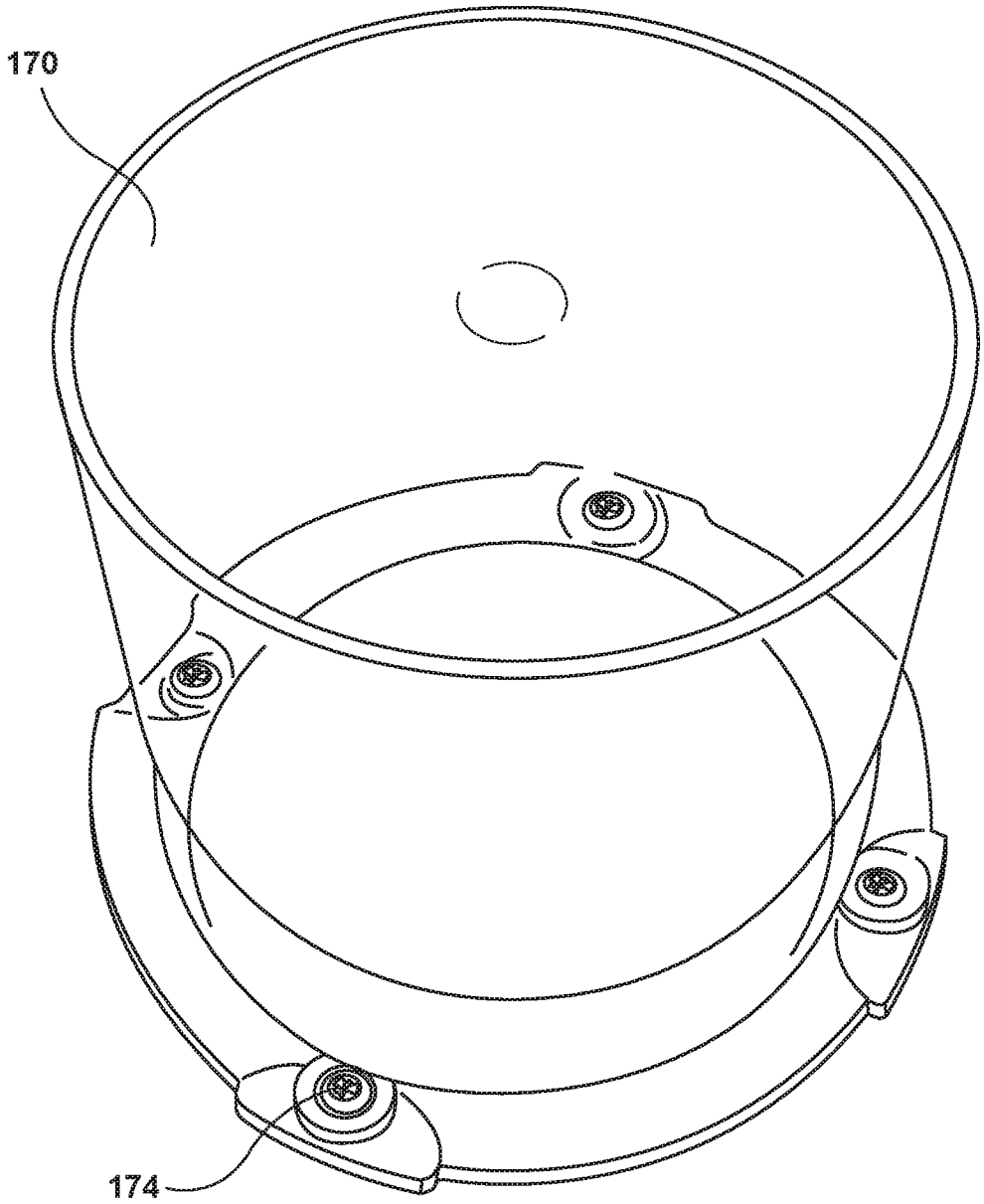
FIG. 9 is a top perspective view of the light distributor without a light filter.

FIG. 8 shows a top perspective view of the lighting device 100 with the light distributor 170 mounted thereto. The light distributor 170 is secured to the lighting device 100 by fasteners 174 joined to the light distributor apertures 114 of the upper light housing member 110. FIG. 9 shows the light distributor 170 with the light filter 180 shown in FIG. 10 removed. The light distributor 170 is a transparent cylindrical member with an open bottom for receiving the light filter 180.

Figure 10:
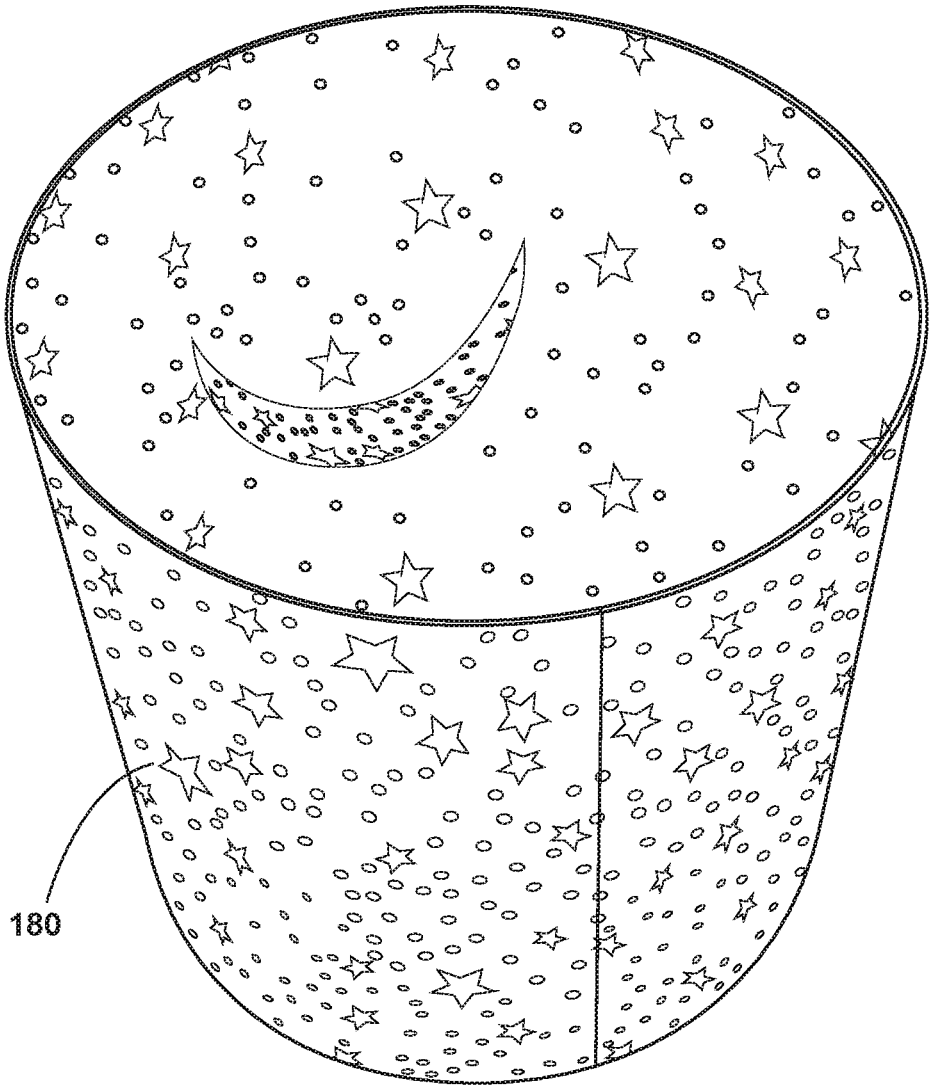
FIG. 10 illustrates a top perspective view of a light filter.
Figure 11:
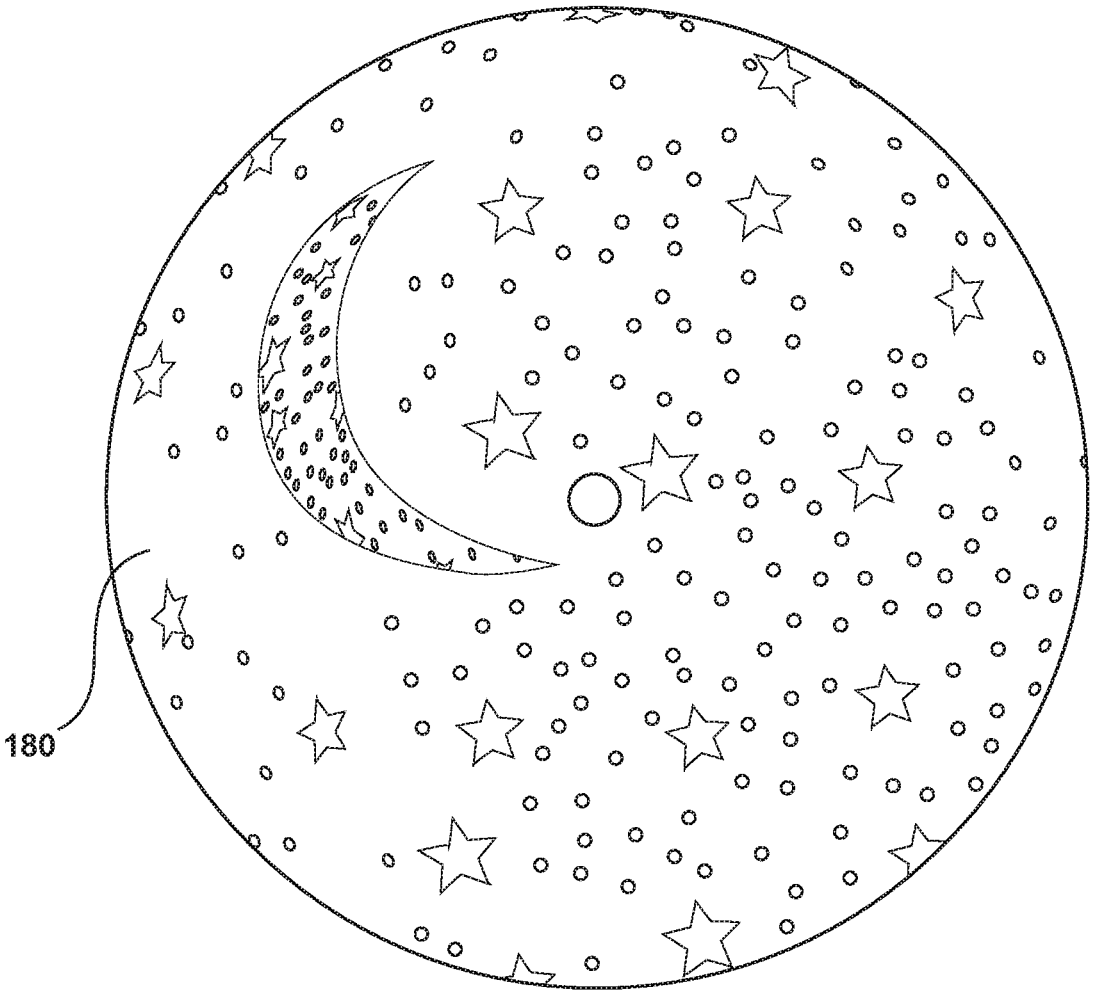
FIG. 11 illustrates a top view of the light filter.

The light filter 180 shown in FIG. 10 includes a lower end that is an open bore so that light output by the LEDs L1-L6 on the circuit board 102 is transmitted within and throughout the interior of the cylindrical light filter. The light filter 180 may be formed from plastic, paper or other material with various types of apertures or indicia printed or otherwise applied to or formed in the light filter 180 and having shapes for passing light therethrough in patterns corresponding to the shapes. FIG. 11 is a top view of the light filter 180 removed from the light distributor 170 and showing exemplary patterns of apertures or indicia for light emitted or projected therefrom.

Assembly of the Article

Figure 11A:
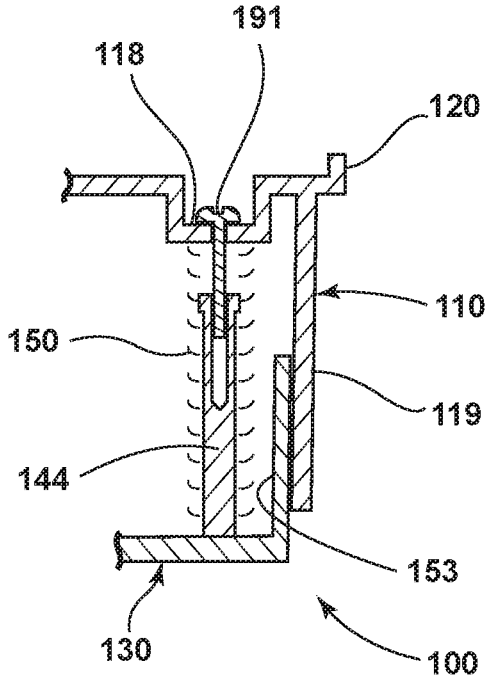
FIG. 11A illustrates a partial cross-sectional view of the lighting device taken at XIA of FIG. 8 with the lighting device assembled.

Assembly of the article 20 first includes mounting the upper light housing member 110 to the lower light housing member 130 to form lighting device 100 so that the receiving post springs 150 apply a biasing force to urge apart or separate the contact switch tab 152 from the contact switch 162 and prevent them from contacting each other in an at-rest state. Thus, a spring biased assembly is formed for biasing the contact switch 162 to an open position. In more detail, upper light housing member 110 and lower light housing member 130 are brought together in a nesting arrangement so that the outer wall 119 of the upper light housing member 110 overlaps the outer wall 153 of the lower light housing member 130 in a telescoping manner to allow relative movement between the upper light housing member 110 and the lower light housing member 130. In addition, when the upper light housing member 110 and the lower light housing member 130 are brought together to form lighting device 100, recessed joining apertures 118 of upper light housing member 110 align with the receiving posts 144 of lower light housing member 130 as shown in the partial cross-sectional view shown in FIG. 11A. Fasteners 191, such as screws, are then inserted through the recessed joining apertures 118 of upper light housing member 110, as shown in FIG. 11A for one exemplary joining aperture. The fasteners 191 are received and fixedly secured in the central apertures of receiving posts 144 to secure upper light housing member 110 and lower light housing member 130 together while allowing a certain degree of relative telescoping movement between the upper light housing member 110 and the lower light housing member 130, as explained below.

Figure 11B:
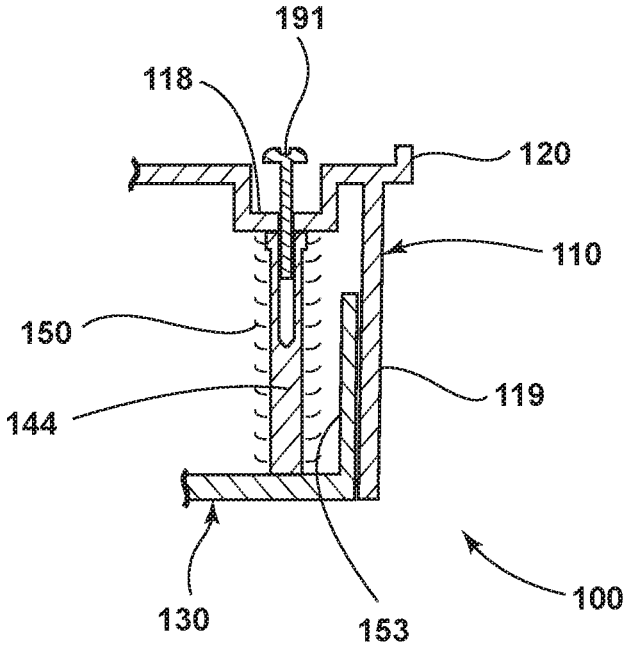
FIG. 11B illustrates a partial cross-sectional view of the lighting device taken along XIA of FIG. 8 with a downward force applied thereto.

When assembled, the receiving post springs 150 exert a biasing force against the upper light housing member 110 that tends to urge the lower light housing member 130 and the upper light housing member 110 away from each other as shown in FIGS. 7 and 11A, with the lower light housing member 130 partially extending outward from the bottom of the upper light housing member 110. When sufficient downward force is applied to the top of article 20 to overcome the biasing force of receiving post springs 150 to compress the springs 150, the upper light housing member 130 will move downwardly in a telescoping fashion along the fasteners 191 which are fixedly secured within the receiving posts 144. When the upper light housing member 110 and lower light housing member 130 move toward each other as described above, they assume the configuration shown in FIG. 11B. Movement of upper light housing member 110 and lower light housing member 130 toward each other causes the contact switch tab 152 and the contact switch 162 to contact, and thereby move the contact switch 162 to the closed switch condition. Thus, the fasteners 191 movably secure the receiving posts 144 to the upper light housing member 110 so movement in one direction occurs to bring the upper housing light member 110 and the lower light housing member 130 toward each other when the receiving post springs 150 are compressed. Such movement causes the lower light housing member 130 to at least partially telescope into the upper light housing member 110 against the biasing force of the receiving post springs 150 as they are compressed as shown in FIG. 11B. Upon release, the receiving post springs 150 all return to their at-rest or a more relaxed state and restore the lighting device 100 to the open switch condition shown in FIGS. 7 and 11A, whereby the respective springs 150 bias the lower light housing member 130 partially away from the upper light housing member 110.

Figure 11C:
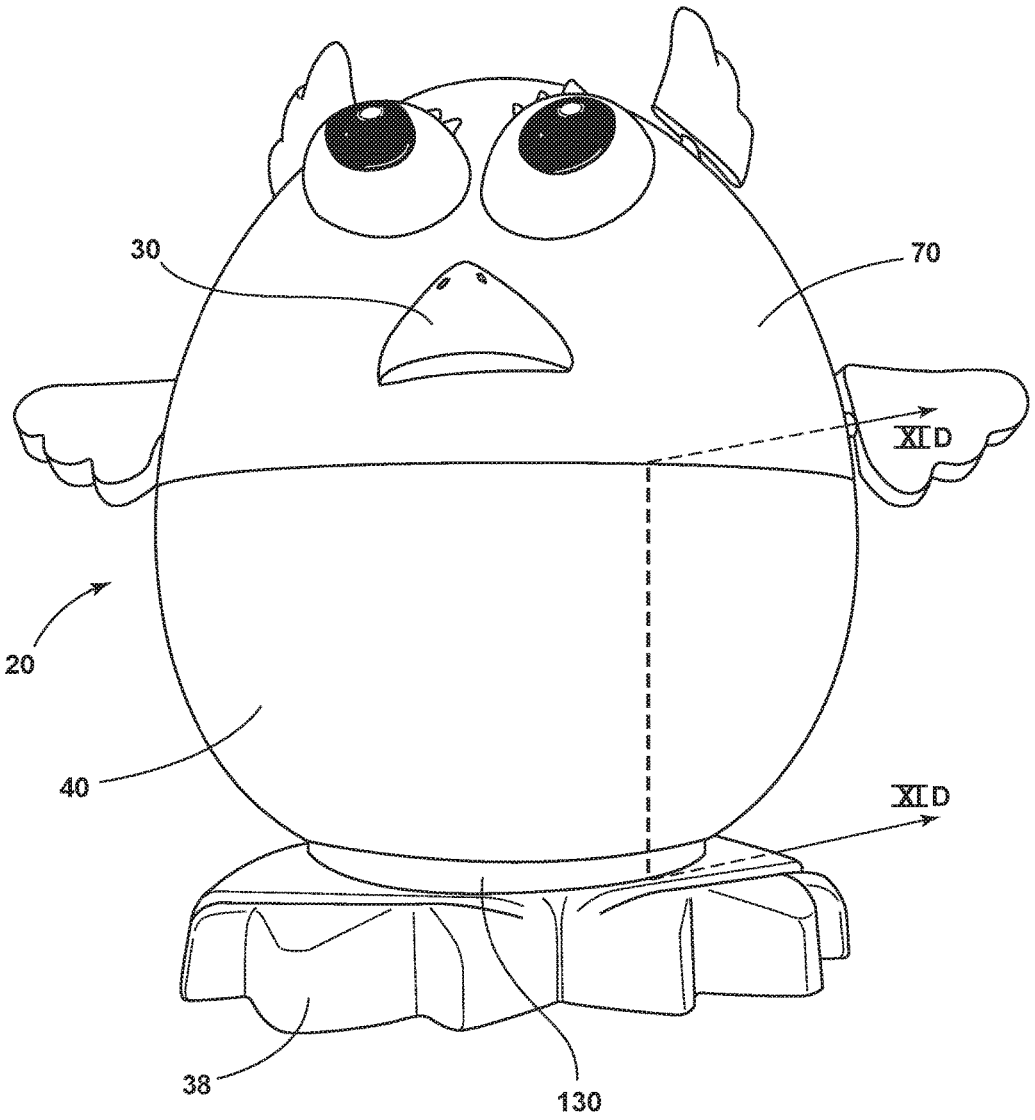
FIG. 11C illustrates a front perspective view of another embodiment of the light-up article that is not illuminated.
Figure 11D:
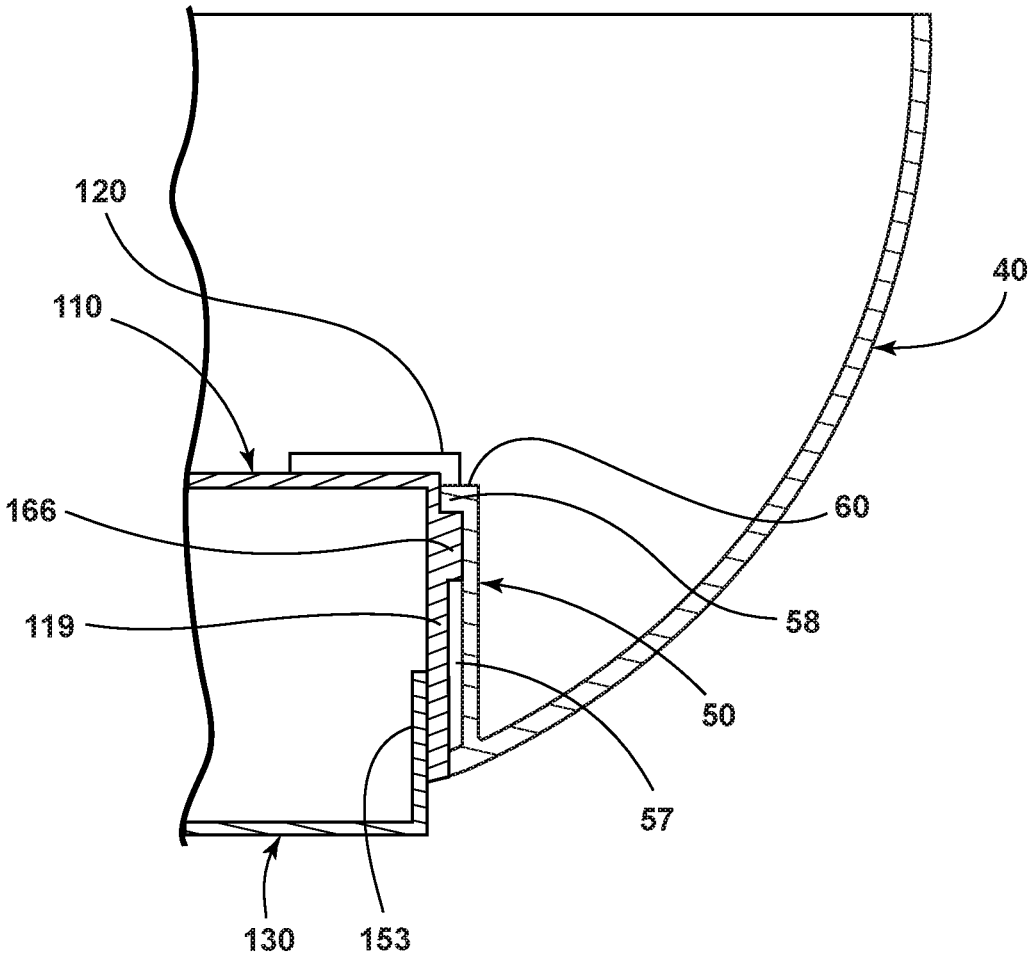
FIG. 11D illustrates a partial cross-sectional view of the lighting device 100 assembled to the bottom article housing piece taken at XID of FIG. 11C.

After the lighting device 100 is assembled, it is attached to light distributor 170 as shown in FIGS. 7 and 8, and then is inserted downwardly into the bottom article housing piece 40 with the opposing mounting projections 166 of the upper light housing member in alignment with opposing grooves 56 in the inner face of the annular flange 50. In the embodiment shown in FIG. 11C, the article 20 or toy stands upright upon the foot appendage 38. Upon insertion of mounting projections 166 into the grooves 56 shown in FIG. 2A, the lighting device 100 and bottom article housing 40 are axially rotated relative to each other so that the mounting projections 166 are disposed below the inwardly extending lips 58 at the top edge 60 of the annular flange 50 as shown in the partial cross sectional view of FIG. 11D. In one embodiment, the length of the mounting projections 166 can be dimensioned such that when the mounting projections 166 are inserted into groove 56, one portion of each projection extends below and along the lip 58 while another portion of each of the mounting projections 166 extends above and in contact with the edge 59 of the groove 56. In other words, each of the mounting projections 166 has an upper edge that contacts a lower edge of lip 58 and a lower edge that contacts the edge 59 of groove 56. Thus, in one embodiment, when the mounting projections 166 are inserted into the grooves 56 and the lighting device 100 is rotated to secure the lighting device in the grooves 56, each of the mounting projections is secured therein. In another embodiment, the mounting projections 166 advance entirely into the grooves under the lower edge of the lips 58. Rotating the lighting device 100 in the opposite direction enables removal of the lighting device 100 from the annular flange 50 in a reversed manner.

In addition, the flange 120 provided about the top edge of the upper light housing member 130 is seated on the top surface 60 of annular flange 50 when the lighting device 100 is secured to bottom article piece 40. Thus, with the mounting projections 166 secured in grooves 56, the flange 120 of the upper light housing member 110 is also seated on the top surface of the flange 50 of the bottom article housing piece 40 about the circumference of the annular flange in areas where the flange is present as shown in FIG. 4. Bottom light housing member 130 is thus coupled via upper light housing member 110 to bottom article housing piece 40.

Thus, the lighting device 100 is fixed or otherwise supported within the bottom article housing piece 40 and the lower light housing member 130 projects partially outwardly from the aperture 54 at the bottom of the bottom article housing piece 40. Thereafter, the upper article housing piece 70 is press fit onto the bottom article housing piece 40 to form the article 20. Various appendages can then be secured in the appendage apertures 78 of the article 20 to create any number of characters, caricatures, or other images and articles. The various appendages include mounting a foot appendage 38 to the appendage apertures 140 disposed in the outer side of the lower light housing member 130. In the embodiment shown in FIG. 11C, the article 20 or toy stands upright upon the foot appendage 38 and the lower light housing member 130 is viewable between the housing 24 and the foot appendage 38.

Operation of the Lighting Device

Figure 12:
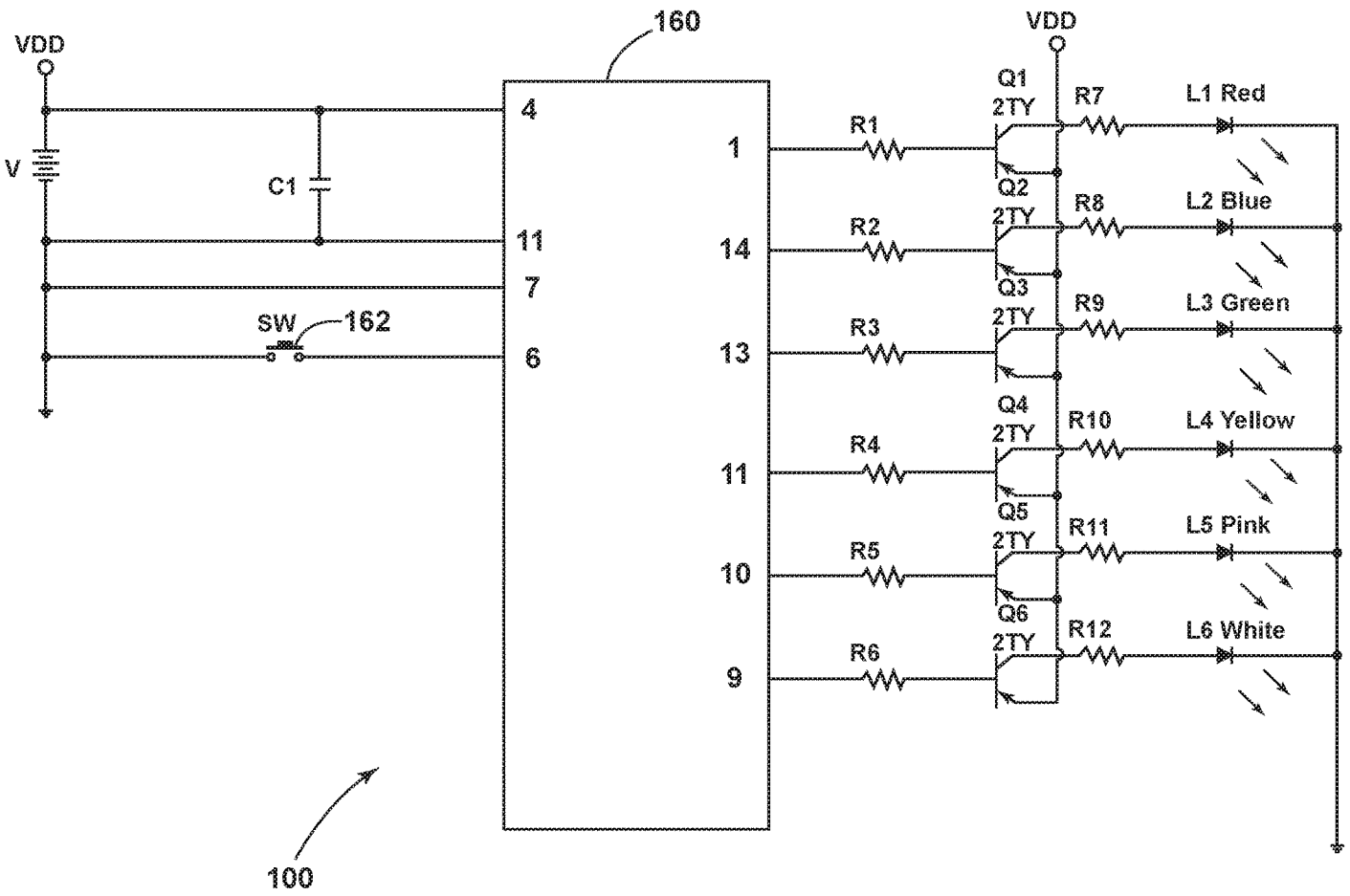
FIG. 12 is an electrical schematic circuit for the lighting device.
Figure 12A:
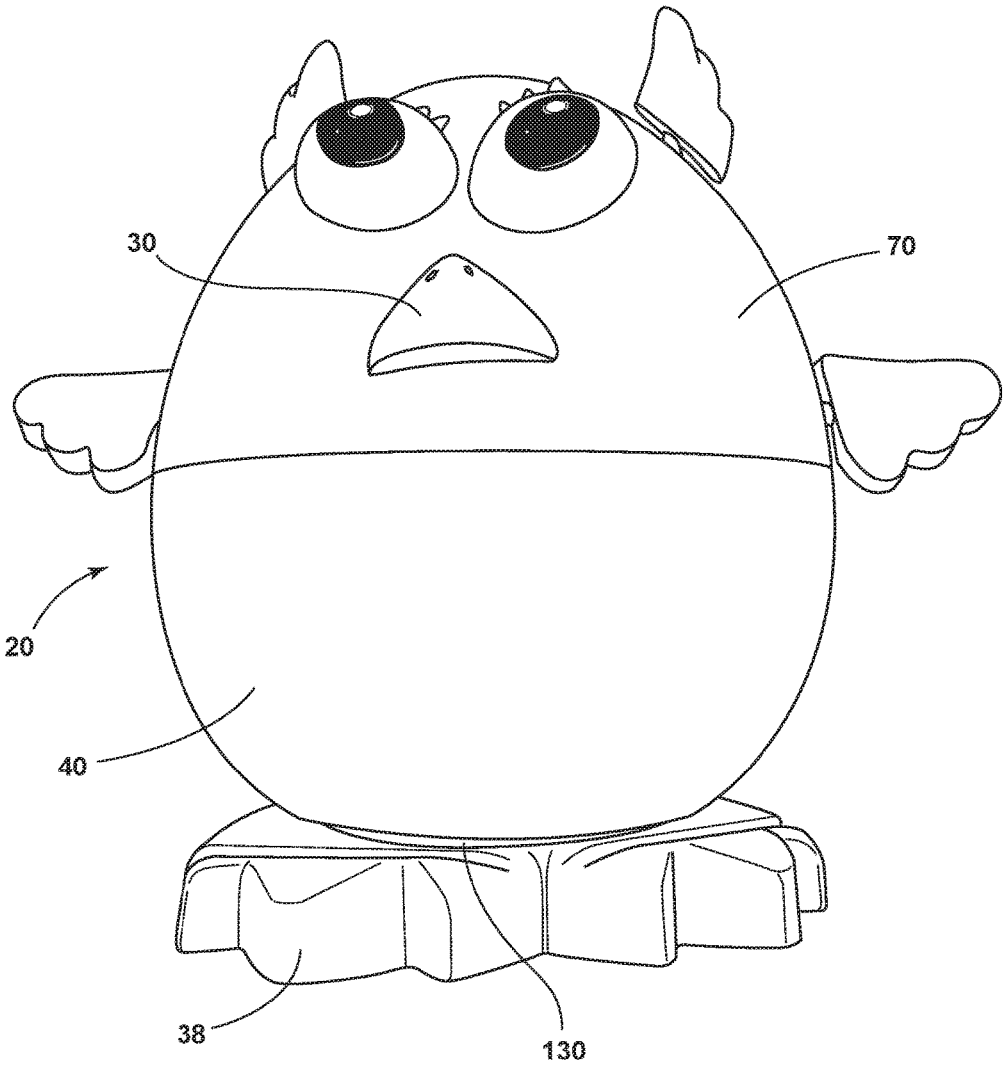
FIG. 12A illustrates a front perspective view of the embodiment of FIG. 11D that is not illuminated and with a downward force applied thereto.

FIG. 12 shows the electrical schematic circuit including the printed circuit board 102 of the lighting device 100. The integrated circuit 160 operates to output various colors of light as follows. A first actuation of the contact switch 162 occurs when a user applies a downward force to the article 20. The downward force moves housing 24, including the upper light housing member 110, downwardly against the biasing force of receiving post springs 150 toward the lower light housing member 130 causing the upper light housing member 110 and the housing 40 to receive and at least partially surround the lower light housing member 130. FIG. 12A shows the outer configuration of article 20 when such a downward is applied. This downward movement of housing 24 and upper light housing member 110 causes the contact switch 162 to contact the contact switch tab 152 resulting in a closing of the contact switch illustrated schematically in FIG. 12 and as discussed with respect to FIG. 11B.

In one exemplary embodiment, upon the first contacting or closing of the contact switch 162, the integrated circuit 160 receives a voltage input at pin 6. In response, in one exemplary embodiment, the integrated circuit 160 is configured to provide an output at pin 1 to power the red LED L1, usually for a predetermined amount of time. Thus, red light is output from the LED L1 upwardly and sidewardly through the light distributor 170 and light filter 180 to the translucent article 20 in this embodiment. When a downward force is applied to the article 20 a second time, the integrated circuit 160 receives an input voltage at pin 6 and switches power only to a blue LED L2, usually for a predetermined amount of time. Upon a third application of force, light is only output by a green LED L3. Upon a fourth downward application of force to the article 20, voltage is only provided to a yellow LED L4, usually for a predetermined amount of time. Upon a fifth application of force that closes the contact switch 162, the integrated circuit 160 provides power to only a pink LED L5 to output pink light, usually for a predetermined amount of time. Upon a sixth application of force, only a white LED L6 outputs light, usually for a predetermined amount of time. Upon a seventh application of force, the LEDs are all off as no power is provided thereto by the integrated circuit 160. Other lighting effects, patterns and sequences of colors are also contemplated in response to actuating the closing of the contact switch 162, including, for example, different flashing light patterns and/or light effects where more than one type of colored light is provided at the same time.

In one embodiment, the integrated circuit 160 shown in FIG. 12 includes an internal timer or circuitry that functions in a similar manner to a timer to stop the output of light, and thus illumination of the article 20 from within, after a preselected time period. Thus, when a LED outputs light for the preselected time period without further actuation of the contact switch 162, the integrated circuit 160 ends power to the LED. In one embodiment, the preselected time period is about twenty seconds. Other preselected time periods are contemplated.

Figure 13:
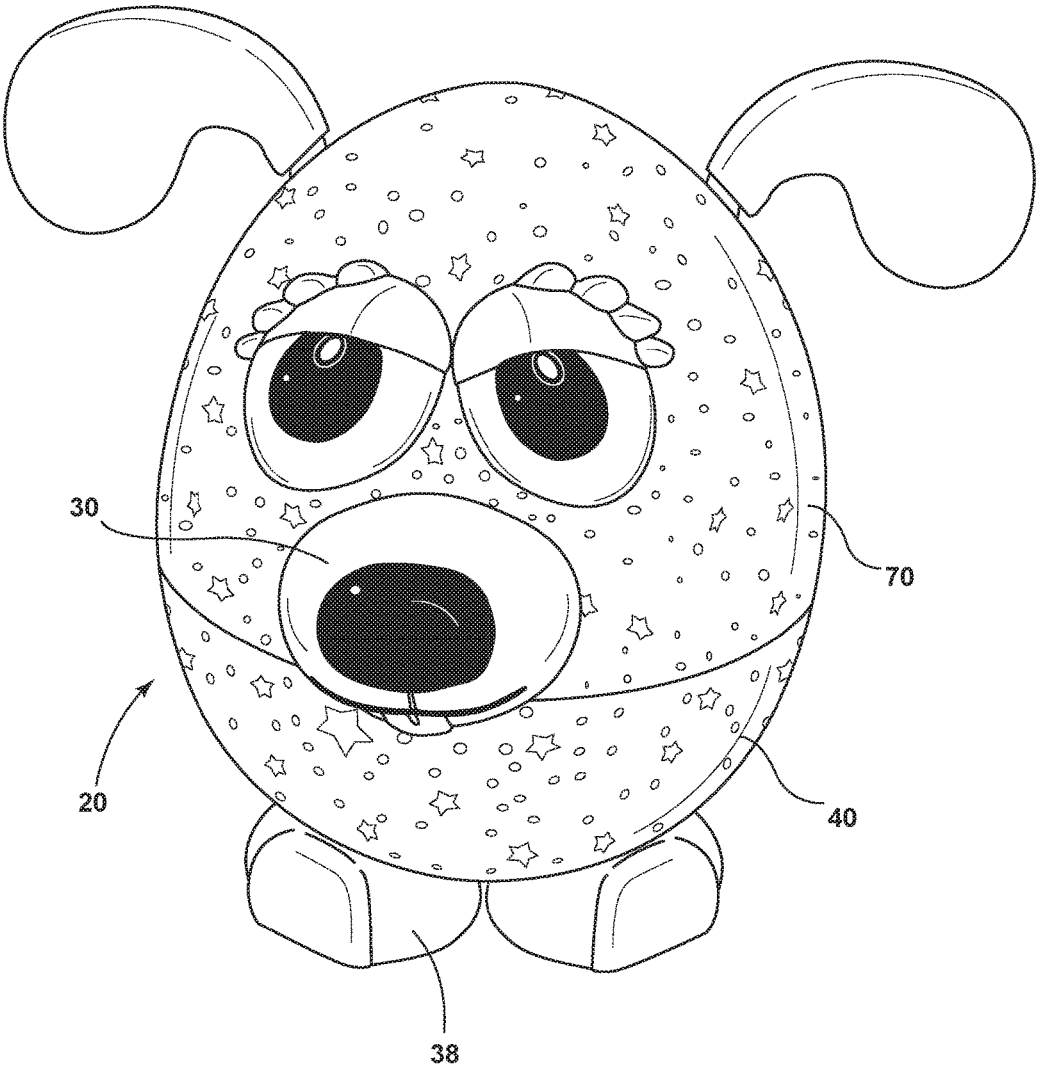
FIG. 13 illustrates a perspective view of the embodiment of FIG. 1 that is illuminated by a light emitting source.
Figure 14:
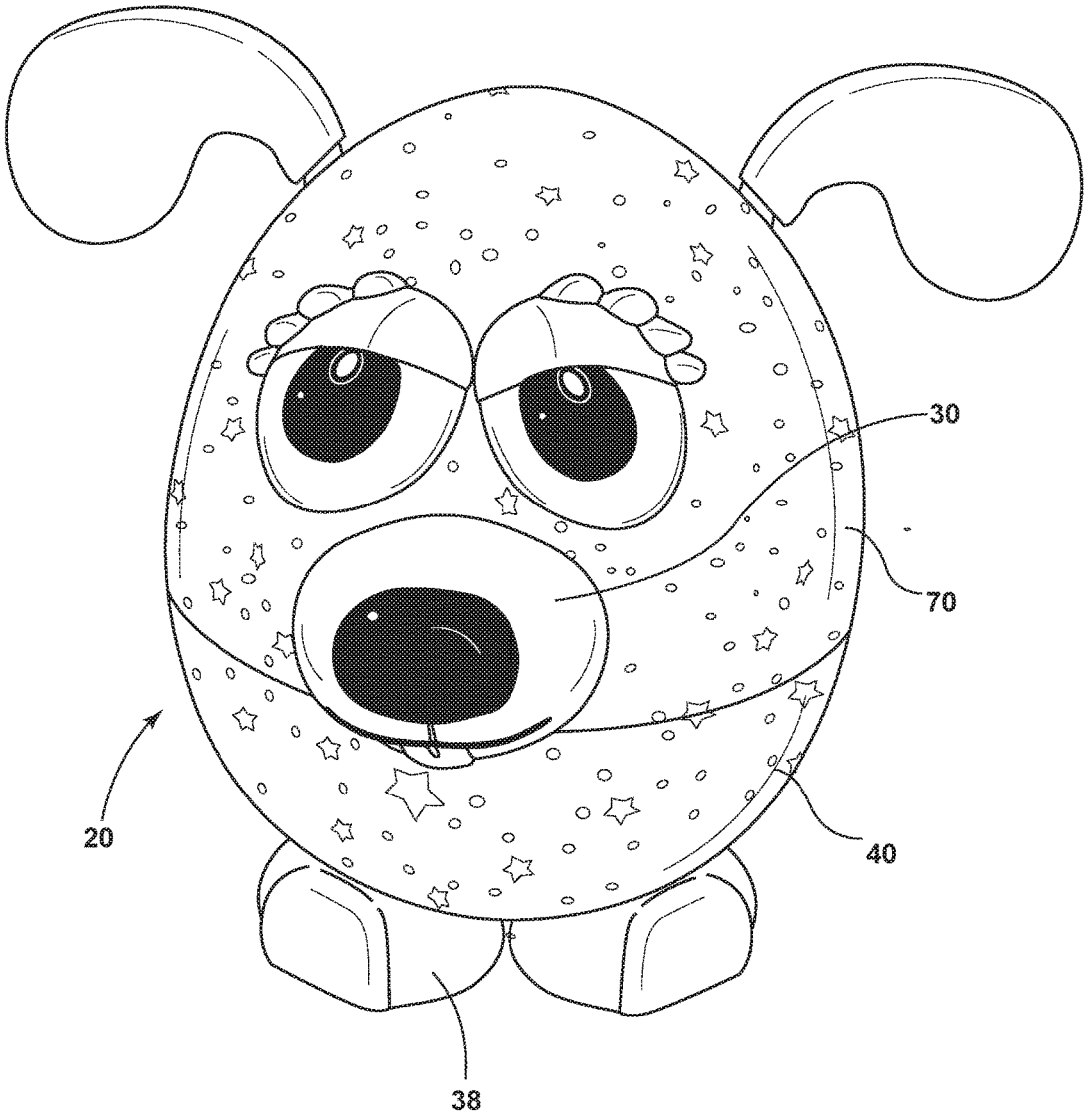
FIG. 14 illustrates a perspective view of the embodiment of FIG. 1 that is illuminated by a light emitting source that is different from the light emitting source in FIG. 13.

In one embodiment, the light filter 180 enables different colors of light to pass through different regions thereof. The pattern output is affected by the position of the LEDs L1-L6 as disposed about the top of the upper light housing member 110. For instance, FIG. 13 shows an embodiment of an article 20 where light from one of the LEDs is projected through filter 180 of light distributor 170 to create a particular pattern over a selected region or area through the translucent bottom article housing piece 40 and the translucent upper article housing piece 70. FIG. 14 shows an embodiment of an article 20 where a different LED projects light through the same filter 180 as used in FIG. 13 and that results in a different pattern or shifted pattern from that of FIG. 13. For example, note that the large star below the nose appendage 30 of the article in FIG. 14 is not illuminated at the same location in FIG. 13 and all other indicia in FIG. 14 have also shifted their positions or are not viewable. This results from different positions of the LEDs L1-L6 on the upper light housing member 110 which shifts the pattern of the light that is output through the light filter 180 and the light distributor 170 and then is projected over different regions or positions on translucent article 20. That is, positioning the LEDs L1-L6 in different positions on the printed circuit board 102 provides a different angle or path for the light emitted by the chosen LED and passing through the light filter 180 and eventually projected onto the bottom article housing piece 40 and/or the upper article housing piece 70 for display. Thus, the light emitting diodes L1-L6 mounted at different locations on the printed circuit board 102 provide light through the light filter 180 in slightly different directions and/or angles to shift a pattern of light that is viewable on the housing of the article 20.

While dots, hearts, circles, letters, stars and half-moon shapes and other light patterns are disclosed, in some embodiments, other patterns are utilized. In one embodiment, at least one from a group consisting of dots, hearts, circles, letters, stars and half-moon shapes is projected through the light filter 180. While the disclosed embodiment provides a selection of colors, other arrangements are contemplated, such as providing a sequence of individual colors or flashing of one or more of the lights at various rates, rather than providing a steady illumination in response to sequential actuation of the contact switch 162. That is, sequential actuation of the contact switch can provide a variety of different lighting effects and patterns, including different sequences of colors and flashing lights.

Figure 15:
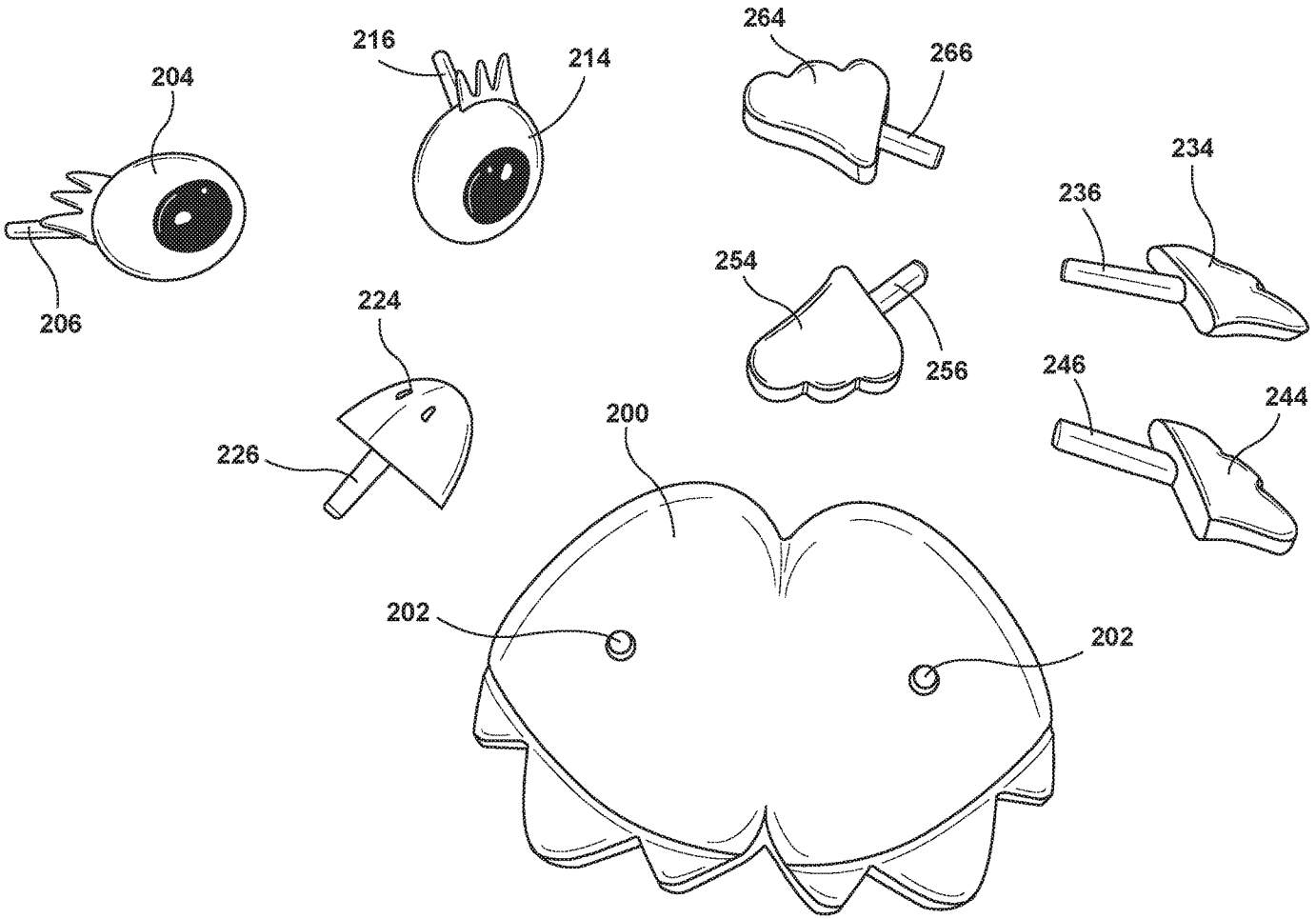
FIG. 15 illustrates a collection of appendages for a light-up article.

FIG. 15 shows another embodiment of various appendages for insertion into apertures of the housing 24 or the pair of apertures on the bottom of the lighting device 100. The appendages include a foot structure 200 with two mounting posts 202. The appendages include a first eye 204 with a mounting post 206, and a second eye 214 with a mounting post 216, and a nose 224 with a mounting post 226. Further, the appendages include a first ear 234 with a mounting post 236 and a second ear 244 with a mounting post 246. Finally, the appendages include a first wing 254 with a mounting post 256 and a second wing 264 with a mounting post 246. The appendages are a generally rigid plastic material and the mounting posts are sized to press fit in the appendage apertures 78 of the housing 24 or the apertures 140 on the bottom of the lighting device 100. For instance, the pair of mounting posts 202 of the foot structure 200 mount in the spaced apertures 140 of the lower light housing member 130.

Figure 16:
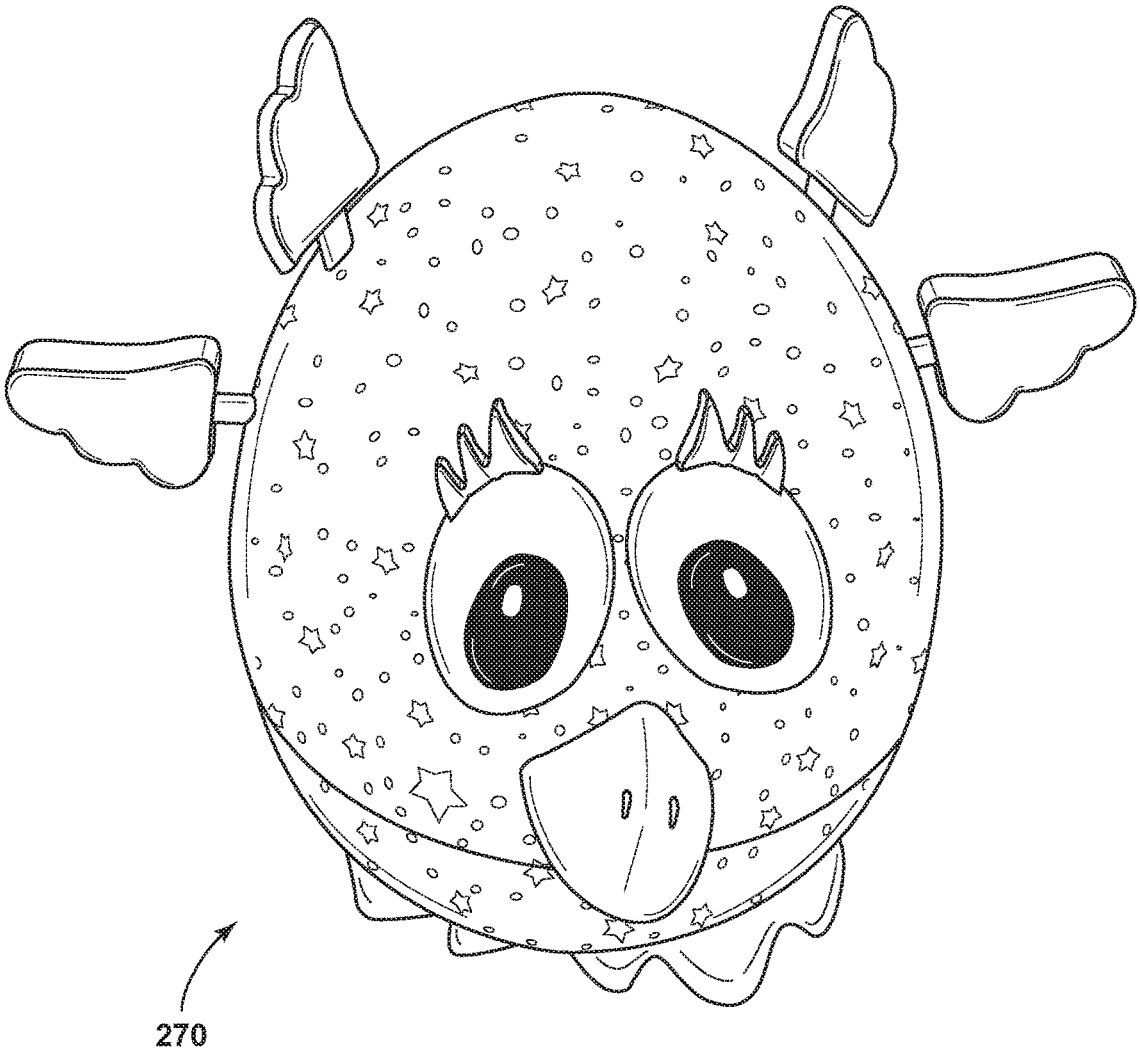
FIG. 16 illustrates a perspective view of another embodiment of the light-up article that is illuminated.
Figure 17:
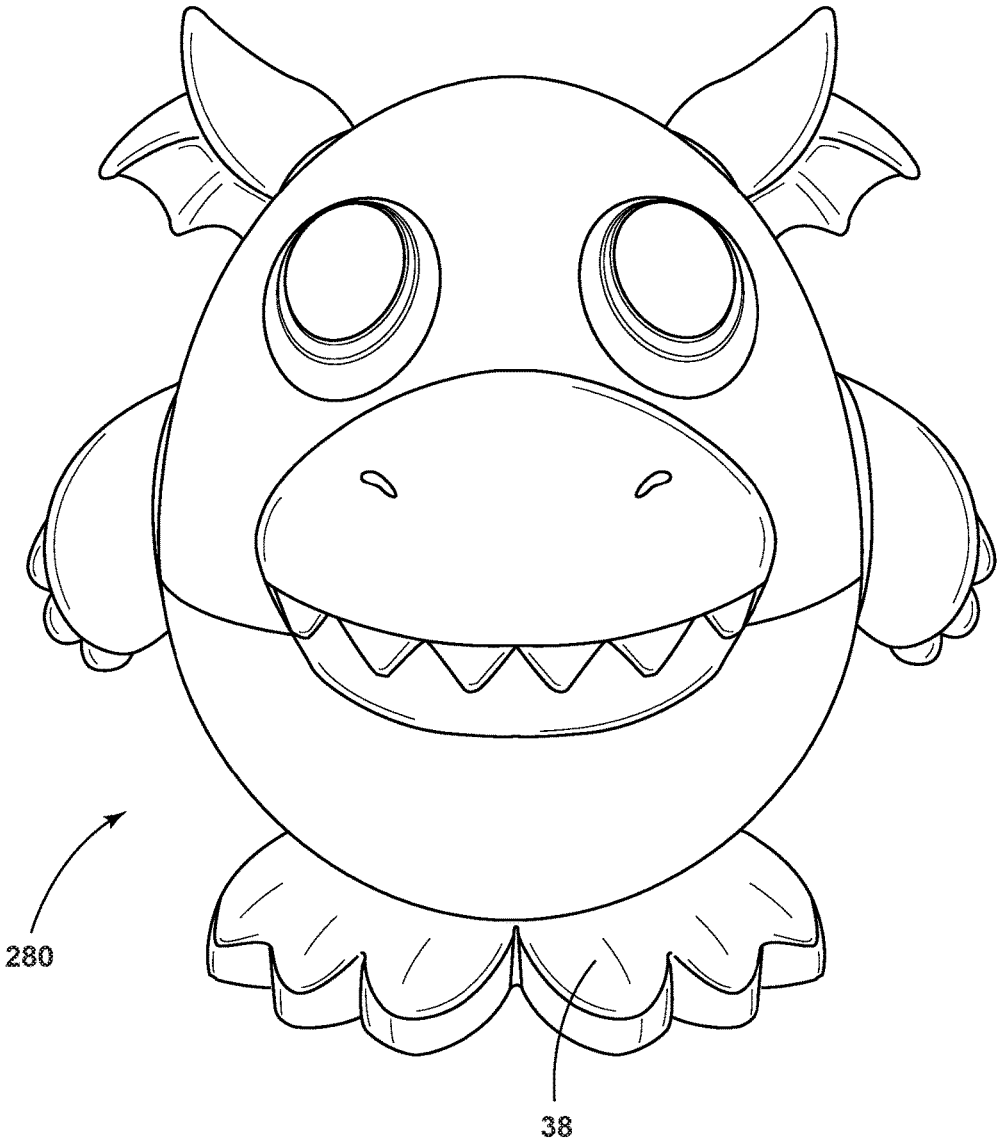
FIG. 17 illustrates a perspective view of yet another embodiment of a light-up article that is not illuminated.
Figure 18:
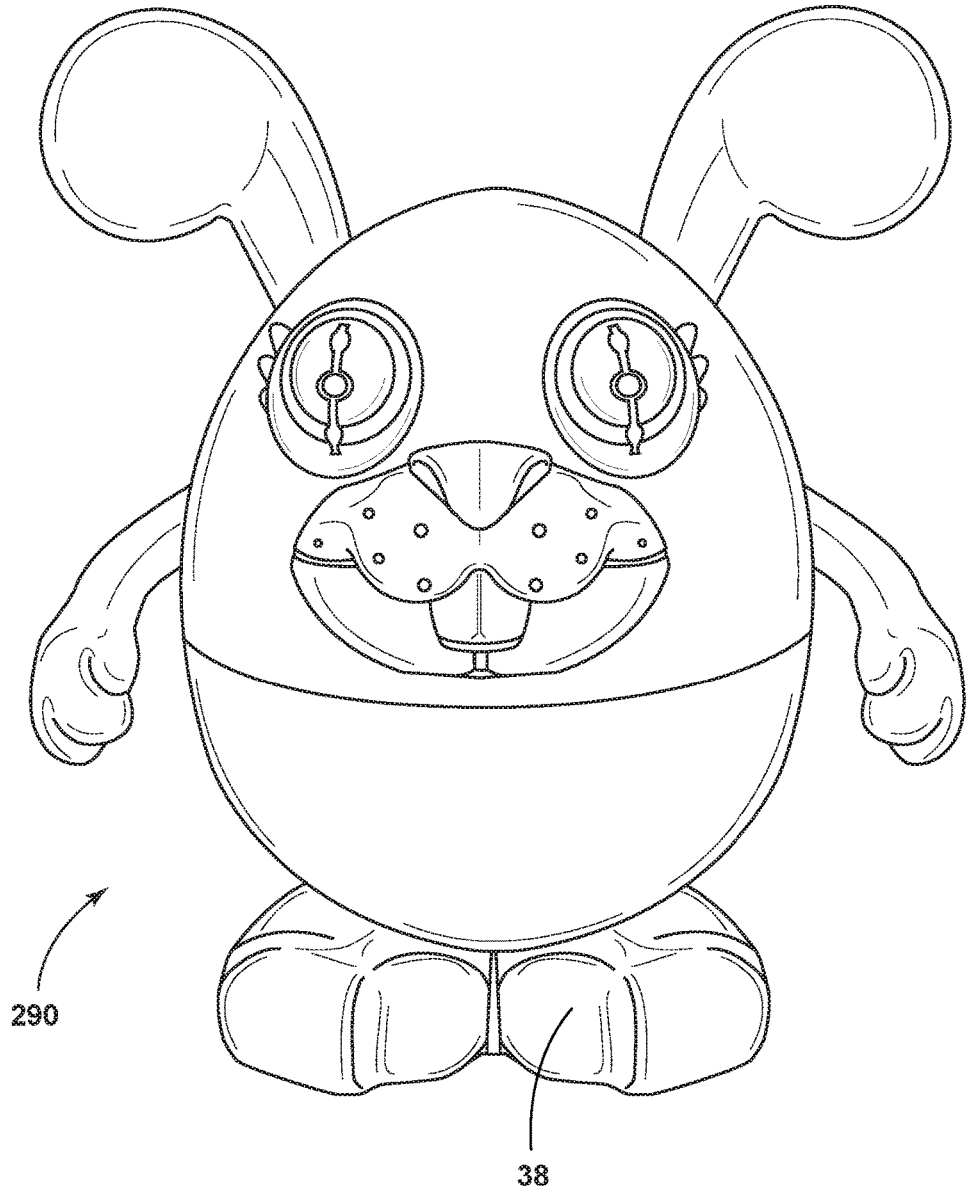
FIG. 18 illustrates a perspective view of a further embodiment of a light-up article that is not illuminated.

The appendages illustrated in FIG. 15 are placed into the various apertures of the housing 24 to form an article 270 of an owl character with a pair of eyes and additional appendages as shown in the embodiment of FIG. 16. FIG. 17 shows another article 280 with appendages defining a character. FIG. 18 shows another article 290 with appendages defining an insect character.

Other appendages are contemplated and may be used to represent, for example, a kitten character or a troll character, along with the dog character for the article 20 having a pair of eyes 26, 28, a pair of ears 34, 36, and additional appendages as shown in FIG. 1. Other appendages may be from, for example, a group including feet, hands, and hair, to name just a few types of appendages that can be used with the subject toy, to create any number of fanciful or real characters, caricatures of persons or animals, images and articles.

Light Projection

Figure 19:
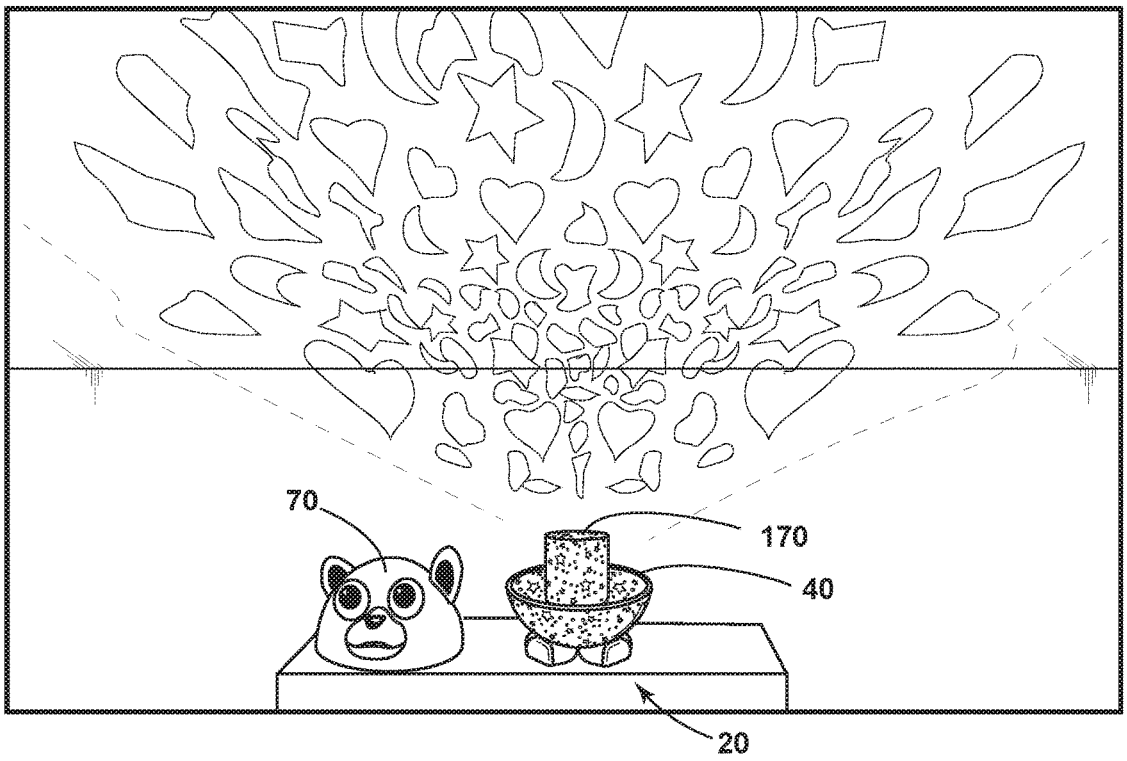
FIG. 19 illustrates a perspective view of an embodiment of a light-up article that is illuminated and with an upper article housing piece removed.

FIG. 19 shows an article 20 with the upper article housing piece 70 removed. With the upper article housing piece 70 removed, light from the lighting device 100 passes through the light filter 180 and the light distributor 170. The light projects onto a wall and a ceiling. FIG. 19 shows hearts, stars, half-moons and other symbols, images or patterns. Additional decorative symbols, patterns, images and characters are contemplated. Besides projecting outwardly and upwardly, FIG. 19 shows light that projects onto the lower article housing piece 40 to provide characters. The arrangement shown in FIG. 19 provides decorative or fanciful patterns of light throughout a room, including a wall, ceiling or other region or surface.

Handle

Figure 20:
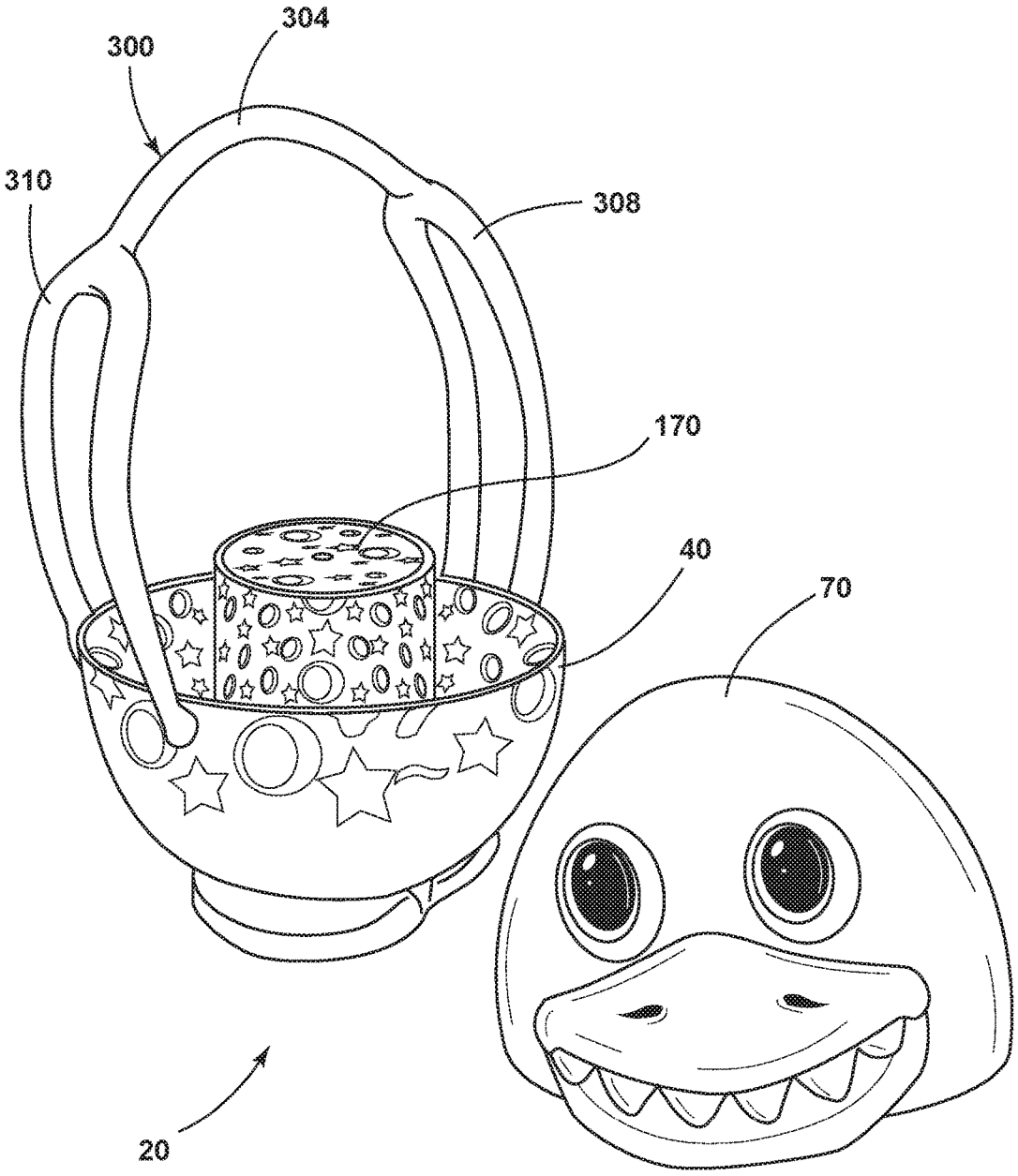
FIG. 20 illustrates a perspective view of an embodiment of the light-up article that is illuminated and with a handle and an upper article housing piece removed.

FIG. 20 shows an article 20 with a handle 300 for allowing grasping and carrying thereof with a single hand. In one embodiment, the handle 300 includes a single elongate top portion 304 for gripping and opposing pairs of forked supports 308, 310 at respective ends of the top portion 304. The forked supports 308, 310 extend from the top portion 304 to pairs of spaced apertures in the bottom article housing piece 40. In one embodiment, respective opposing spaced pairs of apertures in the bottom article housing piece 40 receive the pairs of forked supports 308, 310 in a snap fit manner. Other mounting arrangements, including fasteners secured to ends of the forked supports 308, 310 from the interior of the bottom article housing piece 40 are contemplated. The four support points wherein the handle 300 joins to the bottom article housing piece 40 ensure stability and strength. While FIG. 20 shows the upper article housing piece 70 removed from the article 20, the handle 300 is sized to carry the remainder of the article 20 with the upper article housing piece 70 attached to the bottom article housing piece 40. The removable handle 300 enables the convenience of carrying the article 20 with one hand.

Box

Figure 21:
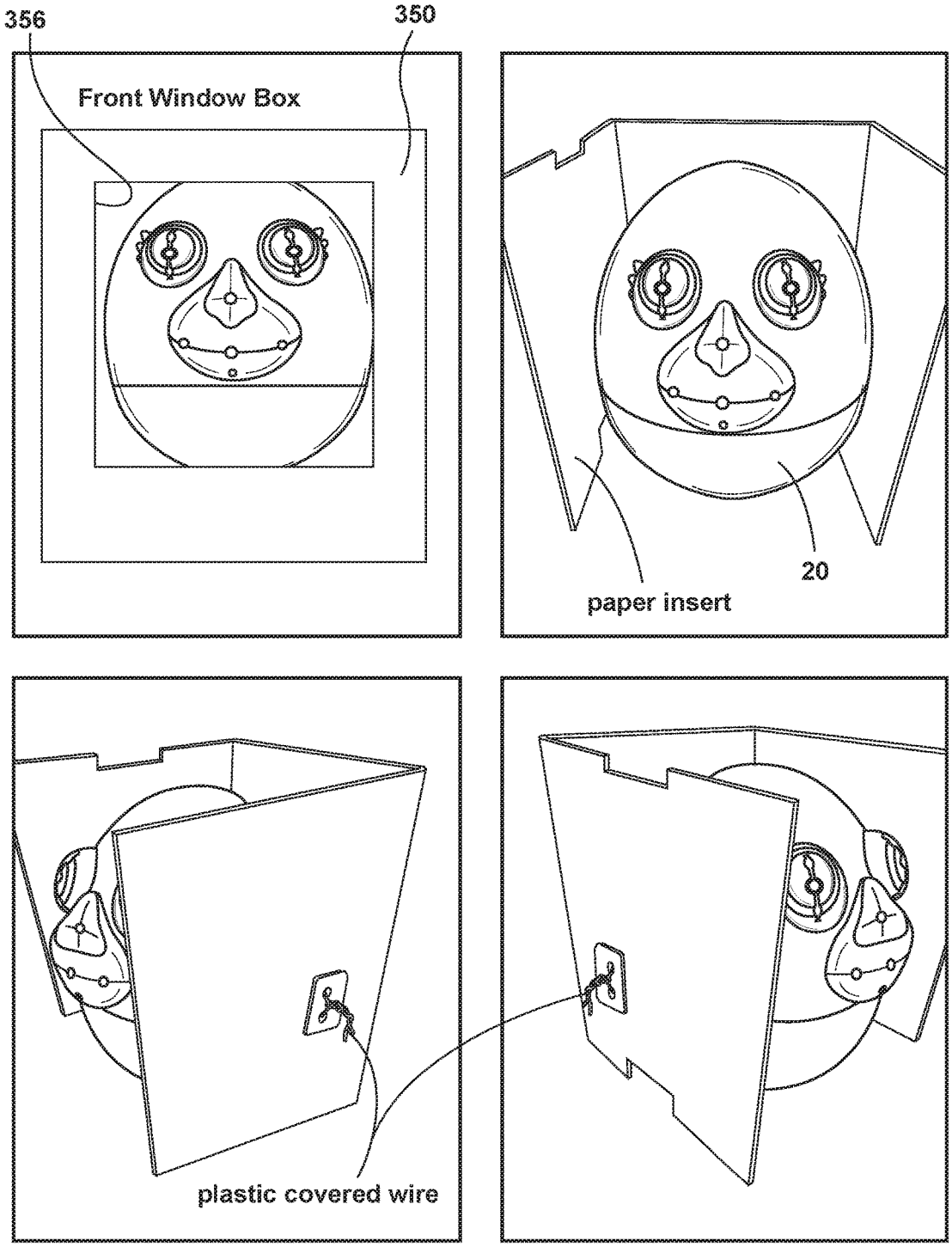
FIG. 21 illustrates perspective views of a display box for the light-up article.

FIG. 21 shows a box 350 with a front window 356 for transporting and displaying the article 20. A paper insert with grooves surrounds the top and a plastic covered wire is provided to secure the article. The front window 356 allows viewing of the article 20 while provided in the box formed by cardboard or thick paper.

In one embodiment, the integrated circuit 160 is an application specific integrated circuit (ASIC). Other electrical components for the integrated circuit 160 are contemplated.

In another embodiment, a loudspeaker and sound generator are provided with the lighting device 100. The loudspeaker outputs sound, including music or verbal statements, in response to application of force to the article 20 in combination with the emitting of light.

Thus, the embodiments as described include, among other things, an article including a housing having an aperture at a bottom thereof that receives a lighting device that extends outwardly from the aperture of the housing. The lighting device includes a contact switch, a spring biased arrangement for biasing the contact switch to an open position; and light emitters for selectively emitting light upon actuation of the contact switch by a generally downward force applied to the article. Various features and advantages of the embodiments are set forth in the following claims.

What is claimed is:

1. An article comprising:

a housing having an aperture at a bottom thereof;

a lighting device positioned within the aperture and extending outwardly from the aperture of the housing, wherein the lighting device is coupled to the housing such that an upper light housing member of the lighting device is fixed in position relative to the housing and a lower light housing member of the lighting device is movable within the aperture relative to the housing, the lighting device including:

a contact switch, a spring biased assembly for biasing the upper light housing member and the lower light housing member of the lighting device in a direction away from each other and the contact switch to an open position, and light emitters for selectively emitting light, wherein the lighting device is configured to selectively provide light upon actuation of the contact switch by a force applied to the article, wherein the article is a toy that selectively provides multiple colors of light, wherein a generally cylindrical annular flange at the bottom of the housing has a groove that opens at and extends downwardly from a top edge of the flange and extends horizontally below the top edge, wherein the lighting device has an outwardly oriented radial mounting projection sized for the groove, whereby insertion of the mounting projection downwardly through the groove and axial rotation of the lighting device fits the lighting device in the aperture, and wherein the lighting device has a generally cylindrical disc shape with a radially outwardly projecting flange about an edge thereof for contacting the top edge of the generally cylindrical annular flange that defines the aperture at the bottom of the housing when the lighting device fits within the aperture.

2. The article according to claim 1, wherein the housing includes appendage apertures for receiving appendages, the appendages including at least one from the group consisting of eyes, nose, ears, feet, hands and hair, wherein the appendages, when secured to the toy, represent a character.

3. The article according to claim 1, wherein the upper light housing member includes a printed circuit board mounted thereon and the lower light housing member includes receiving posts for receiving respective springs, wherein the lower light housing member is partially received within the upper light housing member, and fasteners movably secure the receiving posts to the upper light housing member, whereby the respective springs bias the lower light housing member away from the upper light housing member.

4. The article according to claim 3, wherein the contact switch is provided on an inner face of the upper light housing member and oriented toward the lower light housing member, and the lower light housing member includes an inwardly axially projecting contact switch tab for actuating the contact switch when a downward force is applied to the article moving the upper light housing member toward the lower light housing member against the bias of the springs.

5. The article according to claim 1, wherein the upper light housing member includes a printed circuit board mounted thereon and the light emitters include light emitting diodes mounted to the printed circuit board on top of the upper light housing member, and the article further including a light distributor mounted about the top of the upper light housing member and within the housing, the light distributor receiving a light filter therein, wherein the light emitting diodes provide light through the light filter and the light distributor to the housing of the article, and wherein the housing of the article is translucent.

6. The article according to claim 5, wherein the light emitting diodes include different colors and sequential actuation of the contact switch provides a sequence of colors or different lighting effects.

7. The article according to claim 6, wherein the lighting device stops illumination of the article after a preselected time with no actuation of the contact switch.

8. The article according to claim 5, wherein the light emitting diodes are mounted at different locations on the printed circuit board to provide light through the light filter in different directions or angles that shift a pattern of light that is viewable on the housing of the article.

9. The article according to claim 1, wherein the housing has an oval shape, the housing further comprising 1) a bottom article housing piece having a top opening that has a grooved edge and the generally cylindrical annular flange that defines the aperture at the bottom of the housing, and 2) an upper article housing piece having a bottom opening that has a grooved edge, wherein the grooved edge of the bottom article housing piece and the grooved edge of the upper article housing piece are sized for a press fit connection.

10. The article according to claim 9, wherein the bottom article housing piece includes pairs of spaced apertures, and wherein a handle is attached to the spaced apertures for carrying the article.

11. The article according to claim 9, wherein removing the upper article housing piece and operating the lighting device projects different patterns of light outwardly, whereby the patterns are viewable.

12. The article according to claim 11, wherein the patterns of light include at least one from a group consisting of dots, hearts, circles, letters, stars and half-moon shapes that are formed by a light filter disposed in a light distributor secured to the lighting device, wherein the patterns are capable of being viewed on a wall, ceiling or other surface.

13. An article comprising:

a housing having an aperture at a bottom thereof;

a lighting device positioned within the aperture and extending outwardly from the aperture of the housing, the lighting device including an upper light housing member having a printed circuit board mounted thereon and a lower light housing member movable within the aperture relative to the housing, and light emitters mounted to the printed circuit board on top of the upper light housing member for selectively emitting light;

a light distributor mounted about the top of the upper light housing member and within the housing; and a light filter disposed within the light distributor, the light filter including patterns for selectively allowing light to pass, wherein the light emitters provide light through the light filter and the light distributor to the housing of the article, wherein the housing of the article is translucent, wherein the annular flange at the bottom of the housing has a groove that opens at and extends downwardly from a top edge of the flange and extends horizontally below the top edge, wherein the lighting device has an outwardly oriented radial mounting projection sized for the groove, whereby insertion of the mounting projection downwardly through the groove and axial rotation of the lighting device fits the lighting device in the aperture, and wherein the lighting device has a generally cylindrical disc shape with a radially outwardly projecting flange about an edge thereof for contacting the top edge of the generally cylindrical annular flange that defines the aperture at the bottom of the housing when the lighting device fits within the aperture.

14. The article according to claim 13, wherein the article is a toy that selectively provides multiple colors of light, and the patterns of light include at least one from a group consisting of dots, hearts, circles, letters, stars and half-moon shapes.

15. The toy according to claim 14, wherein the housing includes appendage apertures for receiving appendages, the appendages including at least one from a group consisting of eyes, nose, ears, feet, hands and hair, wherein the appendages, when secured to the toy, represent a character.

16. An article comprising:

a housing having an aperture at a bottom thereof;

a lighting device positioned within the aperture and extending outwardly from the aperture of the housing, the lighting device including:

a contact switch, a spring biased assembly for biasing the contact switch to an open position, and light emitters for selectively emitting light, wherein the lighting device is configured to selectively provide light upon actuation of the contact switch by a force applied to the article, wherein the spring biased assembly of the lighting device includes an upper light housing member having a printed circuit board mounted thereon and a lower light housing member with receiving posts for receiving respective springs, wherein the lower light housing member is partially received within the upper light housing member, and fasteners movably secure the receiving posts to the upper light housing member, whereby the respective springs bias the lower light housing member away from the upper light housing member.

17. The article according to claim 16, wherein the contact switch is provided on an inner face of the upper light housing member and oriented toward the lower light housing member, and the lower light housing member includes an inwardly axially projecting contact switch tab for actuating the contact switch when a downward force is applied to the article moving the upper light housing member toward the lower light housing member against the bias of the springs.

18. An article comprising:

a housing having an aperture at a bottom thereof;

a lighting device positioned within the aperture and extending outwardly from the aperture, wherein the lighting device is coupled to the housing such that an upper light housing member of the lighting device is fixed in position relative to the housing and a lower light housing member of the lighting device is movable within the aperture relative to the housing, the lighting device including:

a contact switch, a spring biased assembly for biasing the upper light housing member and the lower light housing member of the lighting device in a direction away from each other and the contact switch to an open position, and light emitters for selectively emitting light, wherein the upper light housing member includes a printed circuit board mounted thereon and the lower light housing member includes receiving posts for receiving respective springs, wherein the lower light housing member is partially received within the upper light housing member, and fasteners movably secure the receiving posts to the upper light housing member, whereby the respective springs bias the lower light housing member away from the upper light housing member, and wherein the lighting device is configured to selectively provide light upon actuation of the contact switch by a force applied to the article.

19. The article according to claim 18, wherein the contact switch is provided on an inner face of the upper light housing member and oriented toward the lower light housing member, and the lower light housing member includes an inwardly axially projecting contact switch tab for actuating the contact switch when a downward force is applied to the article moving the upper light housing member toward the lower light housing member against the bias of the springs.

* * * * *